US011712908B2

(12) United States Patent
Hayakawa et al.

(10) Patent No.: US 11,712,908 B2
(45) Date of Patent: Aug. 1, 2023

(54) RECORDING DEVICE

(71) Applicant: Seiko Epson Corporation, Tokyo (JP)

(72) Inventors: Naoto Hayakawa, Matsumoto (JP); Keisuke Yamaya, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/411,840

(22) Filed: Aug. 25, 2021

(65) Prior Publication Data

US 2022/0063304 A1 Mar. 3, 2022

(30) Foreign Application Priority Data

Aug. 27, 2020 (JP) ..... 2020-143306

(51) Int. Cl.
*B41J 11/42* (2006.01)
*B41J 11/70* (2006.01)
*B41J 3/60* (2006.01)

(52) U.S. Cl.
CPC ..... *B41J 11/42* (2013.01); *B41J 3/60* (2013.01); *B41J 11/70* (2013.01)

(58) Field of Classification Search
CPC ... B41J 3/60; B41J 11/66; B41J 11/663; B41J 11/70; B41J 11/0045; B41J 11/005; B41J 13/0045; B41J 13/009; B41J 13/14; B41J 13/10; B41J 13/106; B41J 13/103; B41J 15/046
See application file for complete search history.

(56) References Cited

U.S. PATENT DOCUMENTS

2010/0110470 A1* 5/2010 Teshima ..... B41J 3/60 358/1.14
2013/0101329 A1* 4/2013 Kanazawa ..... B26D 7/32 400/621
2020/0062004 A1* 2/2020 Yasumoto ..... A45D 29/00
2021/0170767 A1* 6/2021 Kakigahara ..... B41J 11/706

FOREIGN PATENT DOCUMENTS

JP 2015-063382 4/2015
JP WO2020040205 A1 * 4/2020
WO WO-2020040205 A1 * 2/2020 ..... B41J 11/00214

OTHER PUBLICATIONS

Kakigahara, Hayashida , MachineTranslationofWO-2020040205-A1 (Year: 2020).*
MachineTranslationofJPWO2020040205A1, 2020 (Year: 2020).*

* cited by examiner

*Primary Examiner* — Scott A Richmond
(74) *Attorney, Agent, or Firm* — Workman Nydegger

(57) ABSTRACT

A recording device includes: a storage unit configured to store a medium, a recording unit configured to dispense a liquid droplet onto the medium transported from the storage unit to perform recording, a discharge unit configured to discharge the medium on which recording was performed and an imaging unit disposed on a transport path running from the storage unit, past the recording unit, to the discharge unit, the imaging unit being configured to capture an image of the medium on which recording was performed, where a restricting wall narrowing a space above the medium on the transport path is provided between the recording unit and the imaging unit.

15 Claims, 20 Drawing Sheets

RECORDING DEVICE

The present application is based on, and claims priority from JP Application Serial Number 2020-143306, filed Aug. 27, 2020, the disclosure of which is hereby incorporated by reference herein in its entirety.

BACKGROUND

1. Technical Field

The present disclosure relates to a recording device.

2. Related Art

Conventionally, as illustrated in JP-A-2015-063382, a recording device is known that includes a transport mechanism transporting a medium along a transport path, a recording unit performing recording on a transported medium and a cutting unit cutting the medium on which recording was performed.

In the above recording device, the occurrence of mist during recording is a concern. Furthermore, in the device described above, when a configuration includes an imaging mechanism capturing a recording status of the medium on which recording was performed by the recording unit, the recording status of the medium cannot be accurately captured due to mist adhering to the imaging mechanism.

A recording device recording on a long medium, cutting the long medium on which recording was performed and discharging the medium as a cut sheet is also known. In such a recording device, the occurrence of paper dust during cutting is a concern. Also, even in the above device having a cutting unit, when a configuration includes an imaging mechanism capturing a recording status of the medium on which recording was performed by a recording unit, the recording status of the medium cannot be accurately captured due to paper dust adhering to the imaging mechanism.

SUMMARY

A recording device includes: a storage unit configured to store a medium, a recording unit configured to dispense a liquid droplet onto the medium transported from the storage unit to perform recording, a discharge unit configured to discharge the medium on which recording was performed and an imaging unit disposed on a transport path running from the storage unit, past the recording unit, to the discharge unit, the imaging unit being configured to capture an image of the medium on which recording was performed, where a restricting wall narrowing a space above the medium on the transport path is provided between the recording unit and the imaging unit.

A recording device includes: a storage unit configured to store a medium, a recording unit configured to dispense a liquid droplet onto the medium transported from the storage unit to perform recording, a cutting unit configured to cut the medium on which recording was performed, a discharge unit configured to discharge the cut medium and an imaging unit disposed on a transport path running from the storage unit, past the recording unit, to the cutting unit and the discharge unit, the imaging unit configured to capture an image of the medium on which recording was performed, where a restricting wall narrowing a space above the medium on the transport path is provided between the imaging unit and the cutting unit.

DESCRIPTION OF EXEMPLARY EMBODIMENTS

1. First Embodiment

First, a configuration of a recording device 11 will be described. The recording device 11 according to the present embodiment is an inkjet recording device dispensing ink as a liquid onto a medium M to print. The medium M is, for example, roll paper R and is a long medium wound in a roll shape.

In the following drawings, the recording device 11 is treated as being in a state placed on a horizontal plane. As directions on the horizontal plane, the drawings treat a front-back direction of the recording device 11 as a direction along an X axis and a left-right direction (or width direction) as a direction along a Y axis. Furthermore, a direction vertical (up-down direction) to the horizontal plane is treated as a direction along a Z axis. In addition, a +X direction is treated as a forward direction, a −X direction as a backward direction, a +Y direction as a right direction, a −Y direction as a left direction, a +Z direction as an upward direction and a −Z direction as a downward direction.

Figure 1:
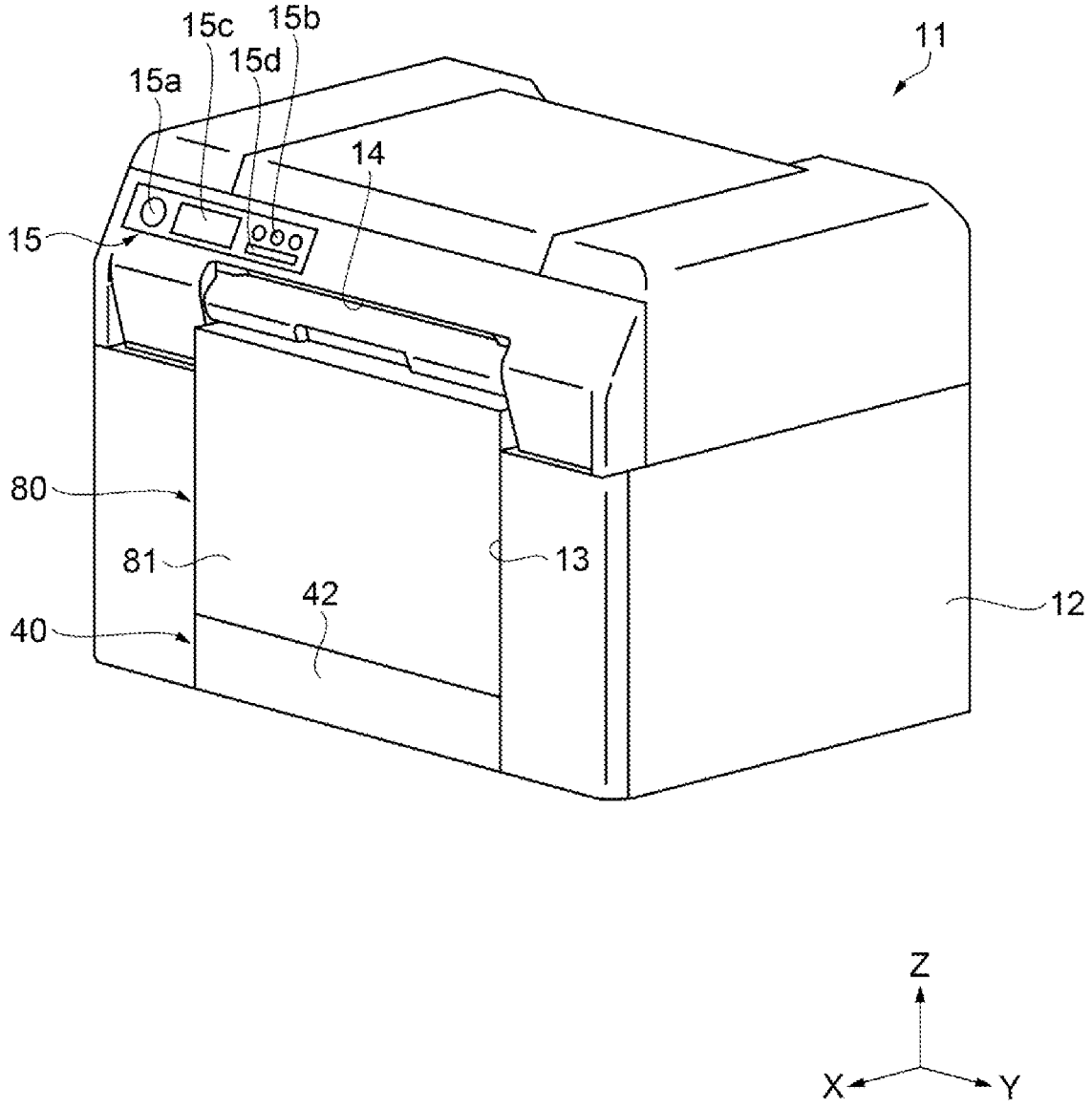
FIG. 1 is a perspective view illustrating an external configuration of a recording device according to a first embodiment.
Figure 2:
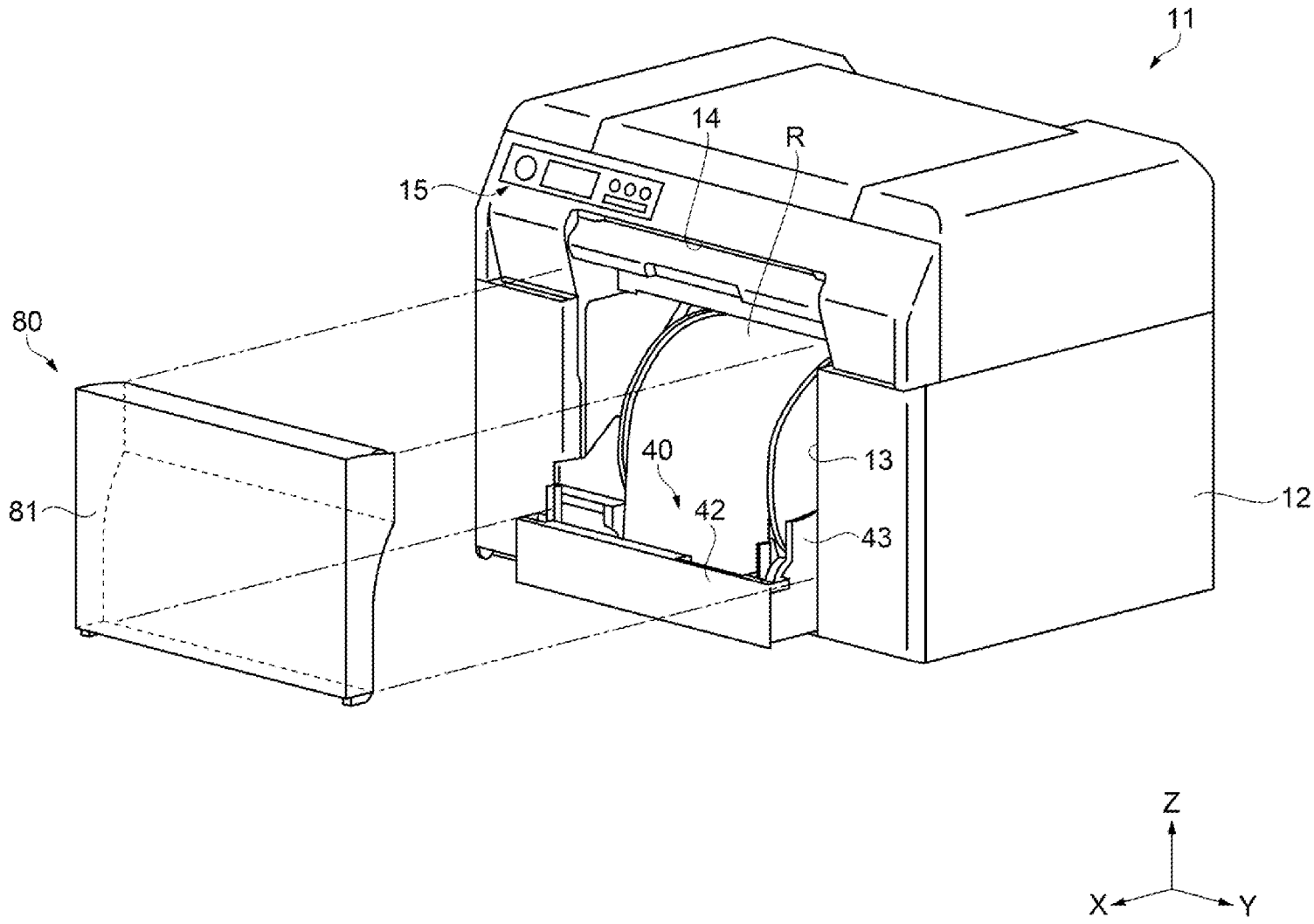
FIG. 2 is a perspective view illustrating an external configuration of the recording device according to the first embodiment.
Figure 3:
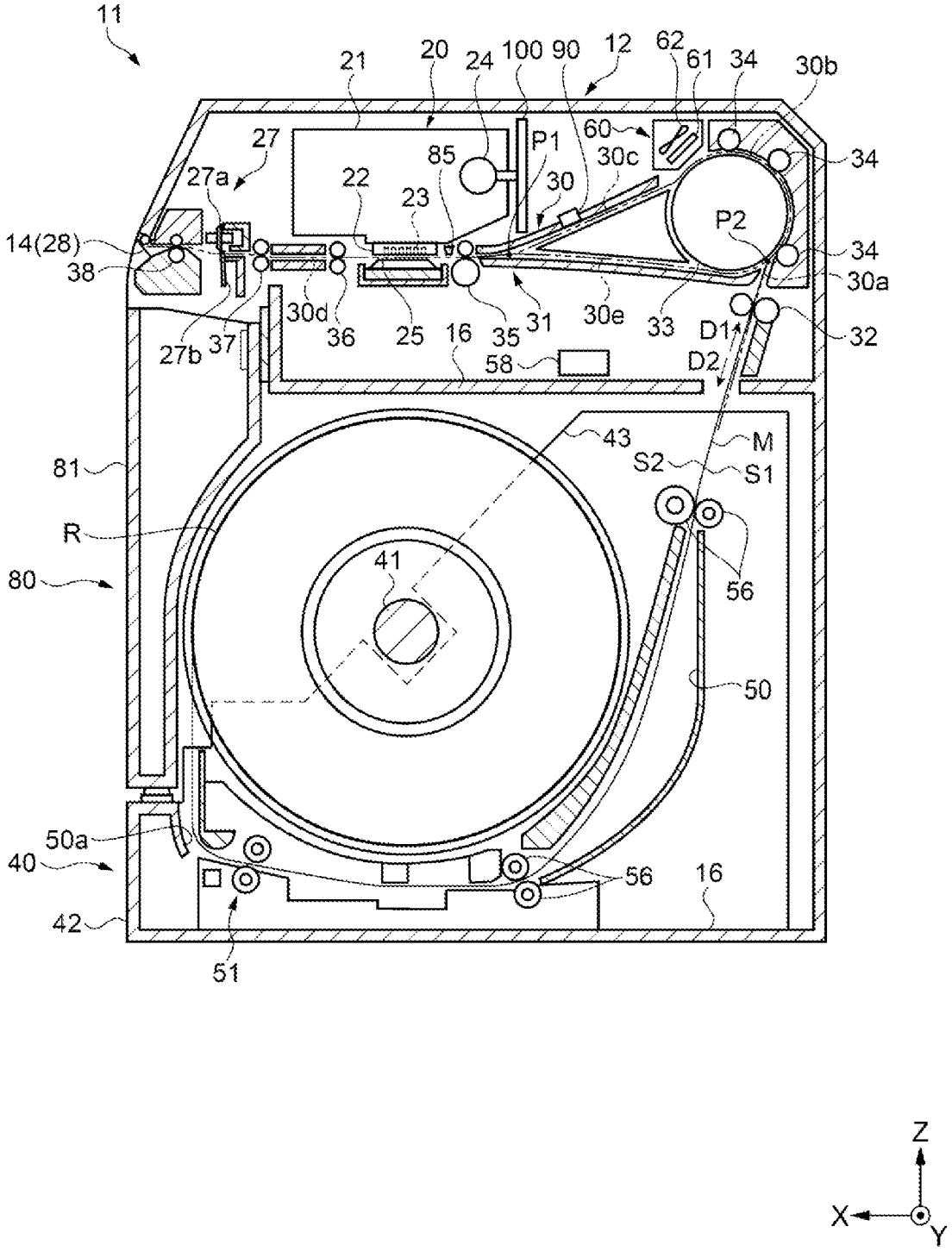
FIG. 3 is a cross-sectional schematic view illustrating an internal configuration of the recording device according to the first embodiment.

As illustrated in FIG. 1, FIG. 2 and FIG. 3, the recording device 11 includes a cuboid housing 12 and a body frame 16 that supports portions of the recording device 11. The housing 12 includes an opening portion 13 opening to a front face. In addition, a discharge port 14 discharging the recorded (printed) and cut medium M is installed in the housing 12. Note that the discharge port 14 constitutes a discharge unit 28.

The recording device 11 includes a storage unit 40 that stores the roll paper R and also feeds out the stored roll paper R. The storage unit 40 is installed such that the storage unit 40 can be pulled from the housing 12 through the opening portion 13 in the forward direction. The storage unit 40 includes a front plate portion 42 that, when stored in the housing 12, constitutes part of the outer packaging of the recording device 11 and a pair of support walls 43 rotatably supporting the roll paper R.

Below the discharge unit 28, a box-shaped cutting waste accommodation unit 80 is provided accommodating cutting waste Ma of the medium M produced by cutting performed by a cutting unit 27. The cutting waste accommodation unit 80 is detachably installed on the front face of the housing 12, forward of the roll paper R. The cutting waste accommodation unit 80 is attached to the housing 12, sealing the opening portion 13. The cutting waste accommodation unit 80 includes an outer wall 81 that, when attached to the housing 12, constitutes part of the outer packaging of the recording device 11.

When the cutting waste accommodation unit 80 is detached from the housing 12, the storage unit 40 can be pulled out of the housing 12. With the storage unit 40 pulled out of the housing 12, the roll paper R is replaced.

Further, an operation unit 15 for operating the recording device 11 is provided on the front of the housing 12. The operation unit 15 is a panel that is long in the direction along the Y axis and is provided with a power button 15*a* operated when turning the recording device 11 on or off, an input button 15*b* capable of inputting various types of operation information and an operation panel 15*c* provided with a display of an operation status of the recording device 11, for example, or an operation button for the recording device 11. The operation panel 15*c* is a touchscreen panel. Additionally, a speaker 15*d* is provided emitting sound to an exterior.

As illustrated in FIG. 3, the recording device 11 includes a transport path 30 (illustrated by a double dot dashed line in the drawing) on which the medium M is transported. The recording device 11 includes a transport unit 31 transporting the medium M along the transport path 30, a recording unit 20 recording on the medium M and the cutting unit 27 cutting the medium M.

The recording unit 20 records on the medium M transported from the storage unit 40. The recording unit 20 includes a head 22 having a nozzle 23 dispensing ink toward the medium M and a carriage 21 on which the head 22 is mounted. The carriage 21 is supported by a guide frame 100 extending along the Y axis and a guide shaft 24 attached to the guide frame 100 and extending along the Y axis. The carriage 21 is movable along the guide shaft 24 with a drive source such as a motor. That is, the carriage 21 is capable of reciprocating in a direction along the Y axis. A support unit 25 supporting the medium M is provided at a position opposite the head 22.

By dispensing ink while reciprocating together with the carriage 21 in a width direction of the medium M, the head 22 records on the medium M supported by the support unit 25. In the present embodiment, a serial head-type recording unit in which the head 22 reciprocates in the width direction was given as an example of the recording unit 20, but the recording unit 20 may be a line head-type recording unit in which the head 22 is fixedly arranged extending in the width direction.

The transport path 30 is a space in which the medium M can move and is configured by a plurality of members. The transport path 30 runs from the storage unit 40 located furthest upstream and feeding out the roll paper R, to the discharge unit 28 (discharge port 14) located furthest downstream. The recording unit 20, the support unit 25 and the like are disposed on the transport path 30.

The cutting unit 27 is located downstream from the support unit 25 and upstream from the discharge port 14. The cutting unit 27 of the embodiment includes a movable blade 27*a* capable of reciprocating in the width direction (left-right direction) and a fixed blade 27*b* that does not move. The movable blade 27*a* is provided above the transport path 30 and the fixed blade 27*b* is provided below the transport path 30. The cutting unit 27 cuts the medium M at a cutting position across the width direction. The cutting position is the position of a blade edge of the fixed blade 27*b*.

The transport path 30 of the embodiment includes, from upstream in the transport direction of the medium M, a first path 30*a* on which the medium M fed out from the roll paper R is transported, a curved path 30*b* on which the medium M is transported while curving, a second path 30*c* on which the medium M is transported toward the head 22 (support unit 25) and a third path 30*d* on which the medium M is transported from downstream of the support unit 25 toward the discharge unit 28.

Furthermore, the transport path 30 includes an inversion path 30*e*. The inversion path 30*e* is a passage connecting a branch point P1 branching from the second path 30*c* and a merge point P2 where the inversion path 30*e* merges into the first path 30*a*. In the transport direction of the medium M transported via the curved path 30*b*, the merge point P2 is located upstream from the branch point P1. That is, the inversion path 30*e* merges upstream of the curved path 30*b*.

The inversion path 30*e* is a path for inverting a cut-sheet medium M and recording on both surfaces of the medium M.

The transport unit 31 transports the medium M along the transport path 30 from the storage unit 40, past the recording unit 20, to the cutting unit 27 and the discharge unit 28. The transport unit 31 includes a feed roller pair 32 provided on the first path 30*a*, a middle roller 33 forming the curved path 30*b*, a driven roller 34 (corresponding to a transport roller) disposed along an outer circumferential surface of the middle roller 33 on the curved path 30*b* and an upstream transport roller pair 35 provided on the second path 30*c*.

The driven roller 34 is provided so as to freely rotate and is driven to rotate with the medium M between the driven roller 34 and the middle roller 33. In the embodiment, a plurality of driven rollers 34 (three in the embodiment) is provided. Accordingly, the inverted medium M can be smoothly transported along the curved path 30*b*.

The transport unit 31 further includes, on the third path 30*d*, a downstream first transport roller pair 36, a downstream second transport roller pair 37 and a downstream third transport roller pair 38. The downstream second transport roller pair 37 is located upstream from the cutting unit 27. The downstream third transport roller pair 38 is located downstream from the cutting unit 27.

Here, a configuration of the storage unit 40 will be described.

The storage unit 40 has the roll paper R rotatably supported via a support shaft 41 extending in a width direction of the housing 12. The support shaft 41 is configured to be capable of rotational drive in both forward and reverse directions. Thus, the roll paper R is driven to rotate in both the forward and reverse directions via the support shaft 41. Furthermore, the storage unit 40 is provided with a roll paper transport track 50 for transporting the medium M fed out from the roll paper R toward the first path 30*a*. The roll paper transport track 50 is part of the transport path 30.

The roll paper transport track 50 extends downward from a front side of the roll paper R that is supported via the support shaft 41 and then bends in the backward direction, goes around the downward direction and backward direction of the roll paper R and extends to a position higher than the roll paper R, moving in the upward direction to the first path 30*a*.

The roll paper transport track 50 has a bent portion 50*a* bending at substantially a right angle at an upstream end portion of the roll paper transport track 50, that is, at a position forward and diagonally downward of the roll paper R on the roll paper transport track 50. A decurling mechanism 51 is provided downstream of the bent portion 50*a* of the roll paper transport track 50, the decurling mechanism 51 performing decurling that corrects roll memory of the medium M fed out from the roll paper R.

Downstream from the decurling mechanism 51 on the roll paper transport track 50, a roll paper transport roller pair 56 imparting transport force to the roll paper R is installed with suitable spacing. When the roll paper transport roller pair 56 drives and rotates, the medium M is fed out from the roll paper R and transported to the first path 30*a*. The roll paper transport roller pair 56 is part of the transport unit 31.

The roll paper transport roller pair 56, the feed roller pair 32, the middle roller 33, the driven roller 34, the upstream transport roller pair 35, the downstream first transport roller pair 36, the downstream second transport roller pair 37 and the downstream third transport roller pair 38 transport the medium M by rotating in a state where the medium M is between the rollers.

When each roller of the transport unit 31 is driven to rotate forward, the medium M is transported from upstream to downstream, and when driven to rotate in reverse, the medium M is transported from downstream to upstream. In the embodiment, the direction going downstream along the transport path 30 is referred to as a progressive feeding direction D1 (corresponding to the transport direction) and the direction going upstream is referred to as a reverse feeding direction D2.

The recording device 11 includes a heating unit 60 heating the transported medium M. The heating unit 60 is positioned facing the middle roller 33 installed on the curved path 30*b*. The heating unit 60 is installed immediately downstream of the furthest downstream driven roller 34 among the three driven rollers 34. The heating unit 60 is configured to correct a curl memory of the medium M. The heating unit 60 of the embodiment includes a heater 61 generating heat and a fan 62 blowing the heat generated by the heater 61 onto the medium M.

Upstream of the head 22, a detection unit 85 is provided that is capable of detecting a leading edge of the transported medium M. In the embodiment, the detection unit 85 is disposed between the upstream transport roller pair 35 and the head 22 on the transport path 30.

The detection unit 85 is, for example, an optical sensor and includes a light emitting unit capable of emitting light and a light receiving unit capable of receiving light. The light emitting unit emits light downward of the optical sensor and the light receiving unit receives reflected light reflected by the medium M. The light emitting unit is configured by a light emitting diode (LED), a laser light emitting element and the like. In addition, the light receiving unit is configured by a phototransistor, a photo IC and the like. The light receiving unit acquires a received amount of received light as a voltage value. Additionally, the amount of received light (voltage value) includes a threshold value for determining the presence or absence of the medium M, and the presence or absence of the medium M is determined based on the threshold value. This enables detection of the leading edge of the medium M.

In addition, the recording device 11 has an imaging unit 90 disposed on the transport path 30 that runs from the storage unit 40, past the recording unit 20, to the discharge unit 28. In the embodiment, the imaging unit 90 is disposed between the curved path 30*b* and the head 22 of the recording unit 20. More specifically, the imaging unit 90 is disposed on the second path 30*c*.

Here, the second path 30*c* is inclined downward from an upper end of the curved path 30*b* toward a dispensing surface (the −Z direction end surface of the head 22) where ink is dispensed from the head 22 of the recording unit 20. Additionally, at least a portion of the imaging unit 90 is disposed between the upper end of the curved path 30*b* and the dispensing surface of the head 22 in the height direction. In the embodiment, the imaging unit 90 is disposed between the upper end of the curved path 30*b* and the dispensing surface of the head 22. Accordingly, the height-direction dimension of the recording device 11 can be constrained.

The imaging unit 90 captures an image of a medium M having a recording. For example, the imaging unit 90 captures a test pattern recorded by the recording unit 20. The imaging unit 90 is, for example, a contact optical sensor (contact image sensor, CIS). The imaging unit 90 is a line-type sensor and includes a photosensor, a light source unit, a lens and the like. The imaging unit 90 can capture a region in the width direction of the medium M. In addition, since the imaging unit 90 is disposed at a position farther away from the discharge unit 28, an effect of ambient light is slight and an image capture function can be ensured.

Here, the test pattern is a pattern formed from a plurality of sets of straight lines corresponding to each nozzle 23 by dispensing ink from the nozzles 23 of the recording unit 20. A dispensing status of a nozzle 23 can be checked using the recorded test pattern. In the embodiment, image data of the test pattern is acquired by the imaging unit 90, and based on the acquired image data, a control unit 58 determines the acceptability of the dispensing status of the nozzle 23. When the control unit 58 determines that the dispensing status of the nozzle 23 is good, a recording (printing) process is performed. On the other hand, when the dispensing status of the nozzle 23 is determined to be poor due to a missing nozzle (missing dots) or the like, a maintenance process such as cleaning can be performed.

Next, a configuration of the control unit 58 of the recording device 11 will be described.

Figure 4:
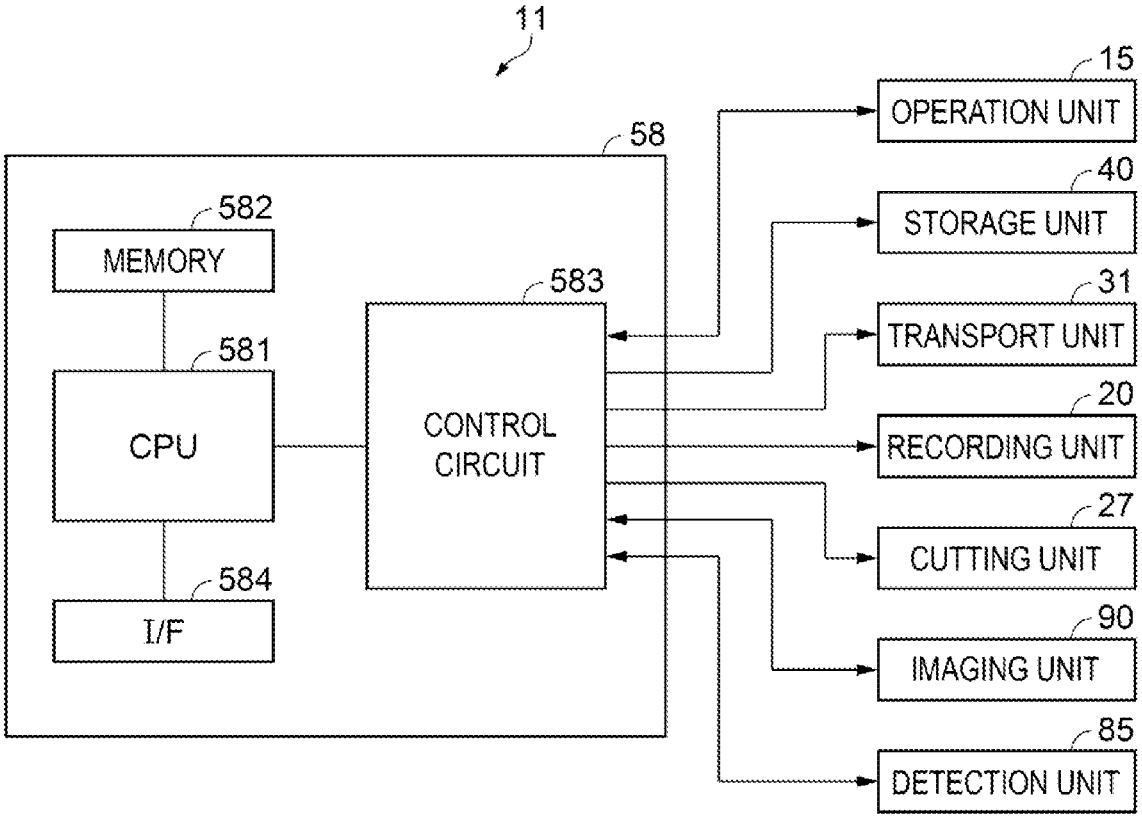
FIG. 4 is a block diagram illustrating a configuration of a control unit of the recording device according to the first embodiment.

As illustrated in FIG. 4, the recording device 11 includes the control unit 58 controlling various operations performed by the recording device 11. The control unit 58 includes a CPU 581, a memory 582, a control circuit 583 and an interface (I/F) 584. The CPU 581 is an arithmetic processing device. The memory 582 is a storage device ensuring a region for storing programs of the CPU 581, a working region and the like and includes a storage element such as a RAM or EEPROM. When recording data and the like is acquired from outside an information processing terminal or the like via the I/F 584, the CPU 581 controls various drive units and the like.

Note that the feed roller pair 32, the middle roller 33, the upstream transport roller pair 35, the downstream first transport roller pair 36, the downstream second transport roller pair 37, the downstream third transport roller pair 38 and the roll paper transport roller pair 56 constituting the transport unit 31 are respectively configured to be capable of drive control.

Next, a control method for the recording device 11 will be described.

First, a control method for recording on a first surface S1 of the medium M will be described. FIG. 5A to FIG. 5E are schematic views illustrating the control method for the recording device 11. Note that the first surface S1 of the medium M is an outer surface when the medium M is wound in a roll. On the other hand, a second surface S2 of the medium M is an inner surface when the medium M is wound in a roll.

Figure 5A:
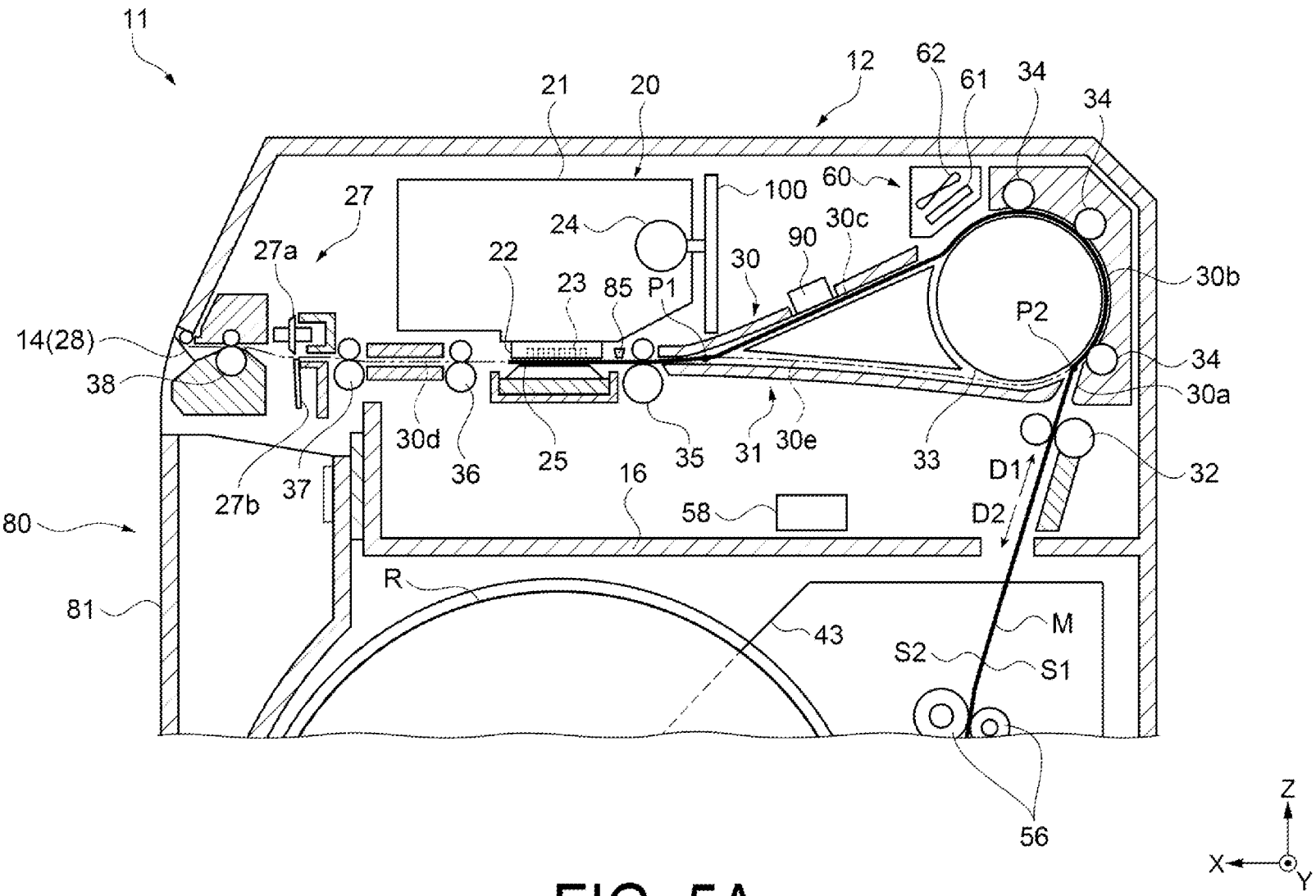
FIG. 5A is a schematic view illustrating a control method for the recording device according to the first embodiment.

First, as illustrated in FIG. 5A, the control unit 58 drives the support shaft 41 of the storage unit 40 and the transport unit 31 to rotate forward and transports the medium M stored in the storage unit 40 in the progressive feeding direction D1 of the transport path 30. The medium M is transported through the roll paper transport track 50, the first path 30*a*, the curved path 30*b* and the second path 30*c* to a position facing the head 22.

Then, the control unit 58 drives the recording unit 20 and records the test pattern on the medium M.

Figure 5B:
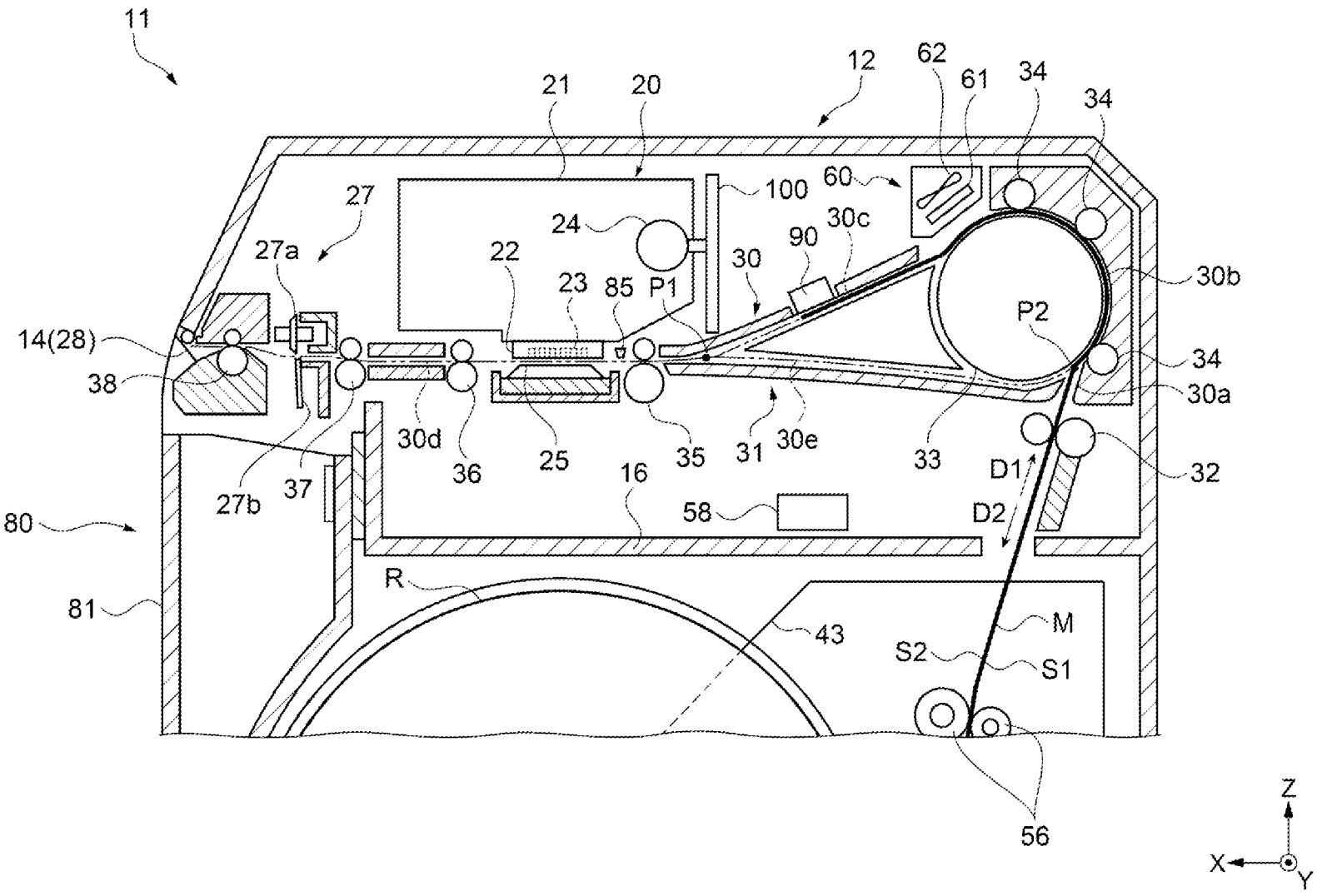
FIG. 5B is a schematic view illustrating the control method for the recording device according to the first embodiment.

Next, as illustrated in FIG. 5B, the control unit 58 drives the transport unit 31 to rotate in reverse and transports the medium M in the reverse feeding direction D2 of the transport path 30. Specifically, the medium M is transported to a position where the portion of the medium M where the test pattern is recorded faces the imaging unit 90.

Then, the control unit 58 drives the imaging unit 90 and captures the test pattern. Captured image data (information) is transmitted to the control unit 58. The control unit 58 determines the status of dispensing by the recording unit 20 based on the image data transmitted from the imaging unit 90. For example, the presence or absence of a missing nozzle in the head 22 is determined.

When there is determined to be no missing nozzle in the head 22, the recording process continues. On the other hand, when there is determined to be a missing nozzle in the head 22, a maintenance process such as cleaning is performed.

In addition, notification of a determination result is given based on a determination result from the control unit 58. Specifically, the determination result may be displayed on the operation panel 15*c* of the operation unit 15 acting as a notification unit, or the determination result may be reported by sound via the speaker 15*d*. Accordingly, the user can easily learn the status of dispensing by the recording unit 20.

Figure 5C:
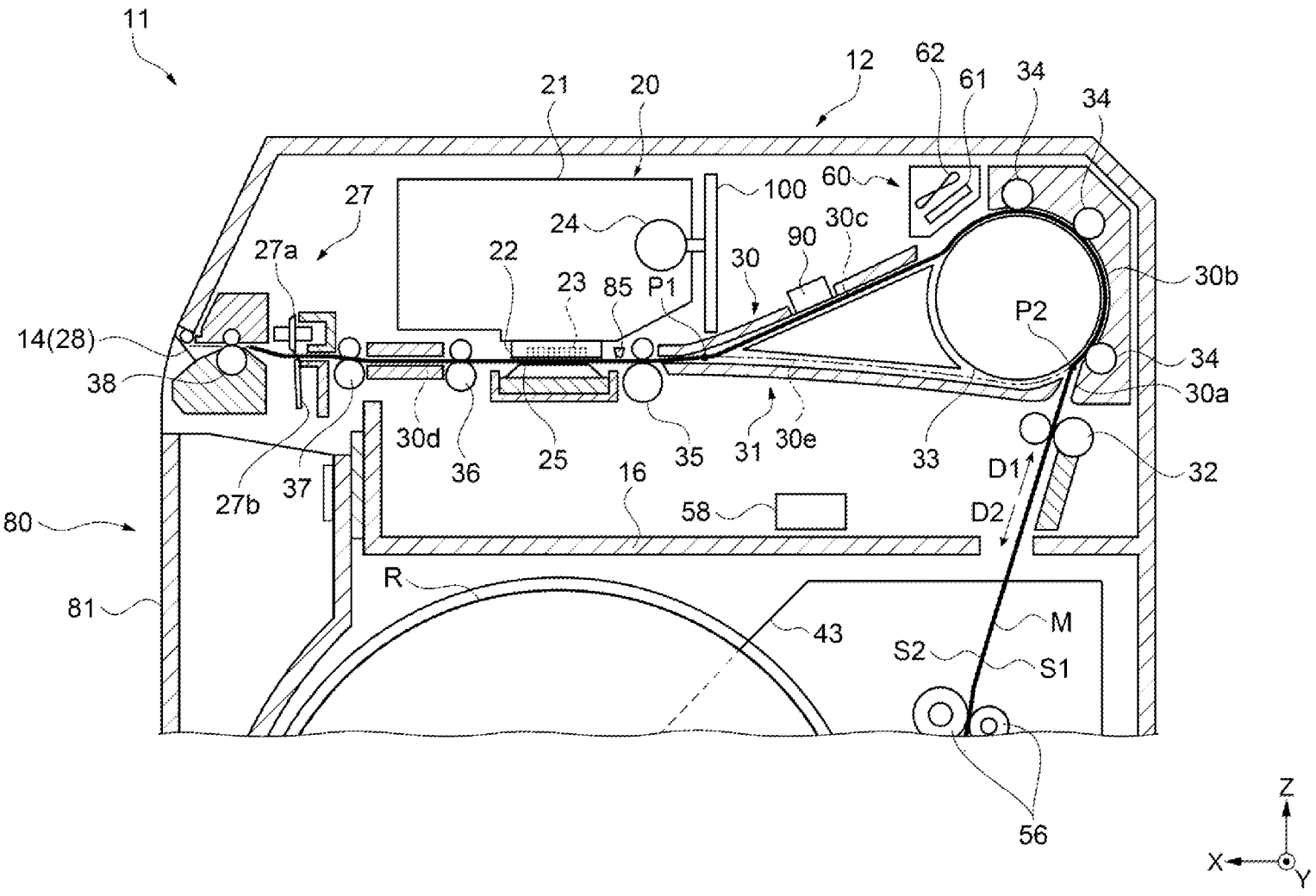
FIG. 5C is a schematic view illustrating the control method for the recording device according to the first embodiment.

Next, when there is determined to be no missing nozzle in the head 22, as illustrated in FIG. 5C, the control unit 58 drives the support shaft 41 of the storage unit 40 and the transport unit 31 to rotate forward and transports the medium M in the progressive feeding direction D1 of the transport path 30. Specifically, the medium M is transported until the portion of the medium M where the test pattern is recorded is positioned downstream of the cutting unit 27.

Then, the control unit 58 drives the cutting unit 27 and cuts the portion of the medium M where the test pattern is recorded.

Figure 5D:
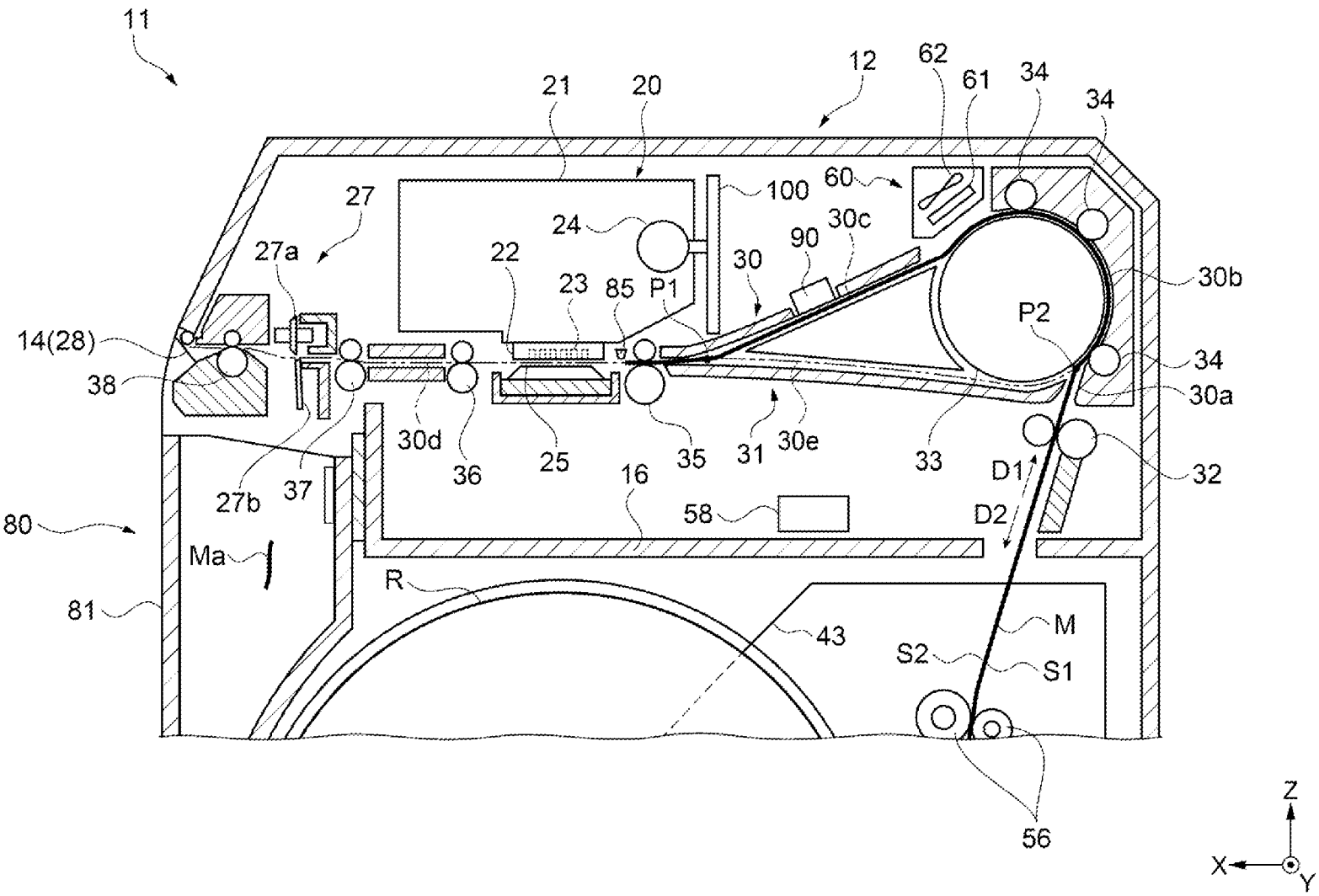
FIG. 5D is a schematic view illustrating the control method for the recording device according to the first embodiment.

Next, as illustrated in FIG. 5D, the cutting waste Ma of the cut medium M falls downward and is accommodated in the cutting waste accommodation unit 80.

In addition, the control unit 58 drives the transport unit 31 to rotate in reverse and transports the medium M in the reverse feeding direction D2 of the transport path 30. Also, the control unit 58 drives the detection unit 85 and stops driving the transport unit 31 at a position where the leading edge of the medium M is detected by the detection unit 85. Accordingly, as illustrated in FIG. 5D, the leading edge of the medium M stops in a state positioned upstream of the head 22.

Figure 5E:
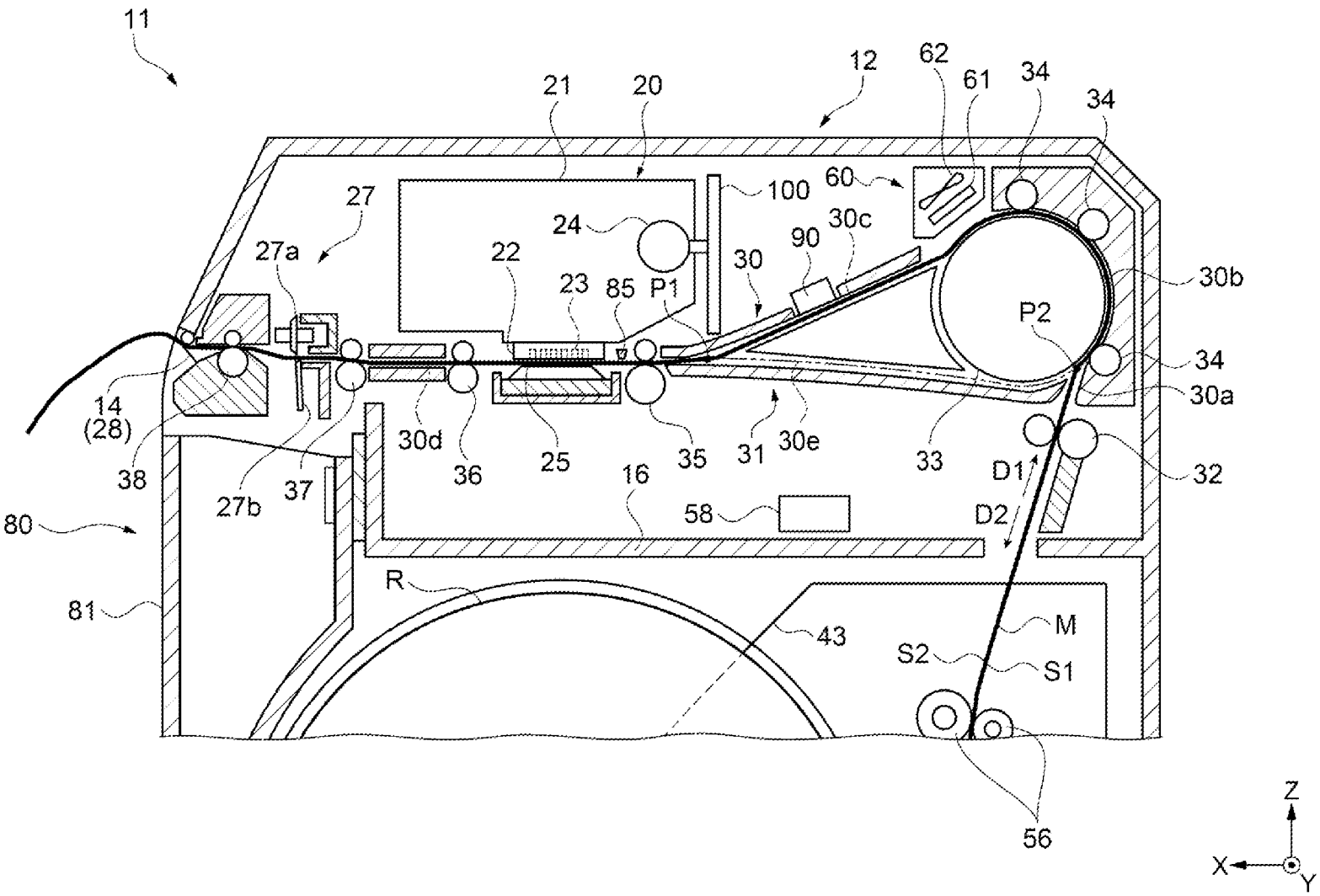
FIG. 5E is a schematic view illustrating the control method for the recording device according to the first embodiment.

Next, as illustrated in FIG. 5E, the control unit 58 drives the transport unit 31 and the recording unit 20 and records an image on the medium M while transporting the medium M in the progressive feeding direction D1 of the transport path 30.

Then, at a predetermined juncture, the control unit 58 drives the cutting unit 27 and cuts the medium M. The cut medium M is discharged from the discharge unit 28.

Next, a control method will be described for double-sided printing, which records on the medium M on the first surface S1 and the second surface S2, the opposite surface from the first surface S1. FIG. 6A to FIG. 6D are schematic views illustrating the control method for double-sided printing in the recording device 11.

Figure 6A:
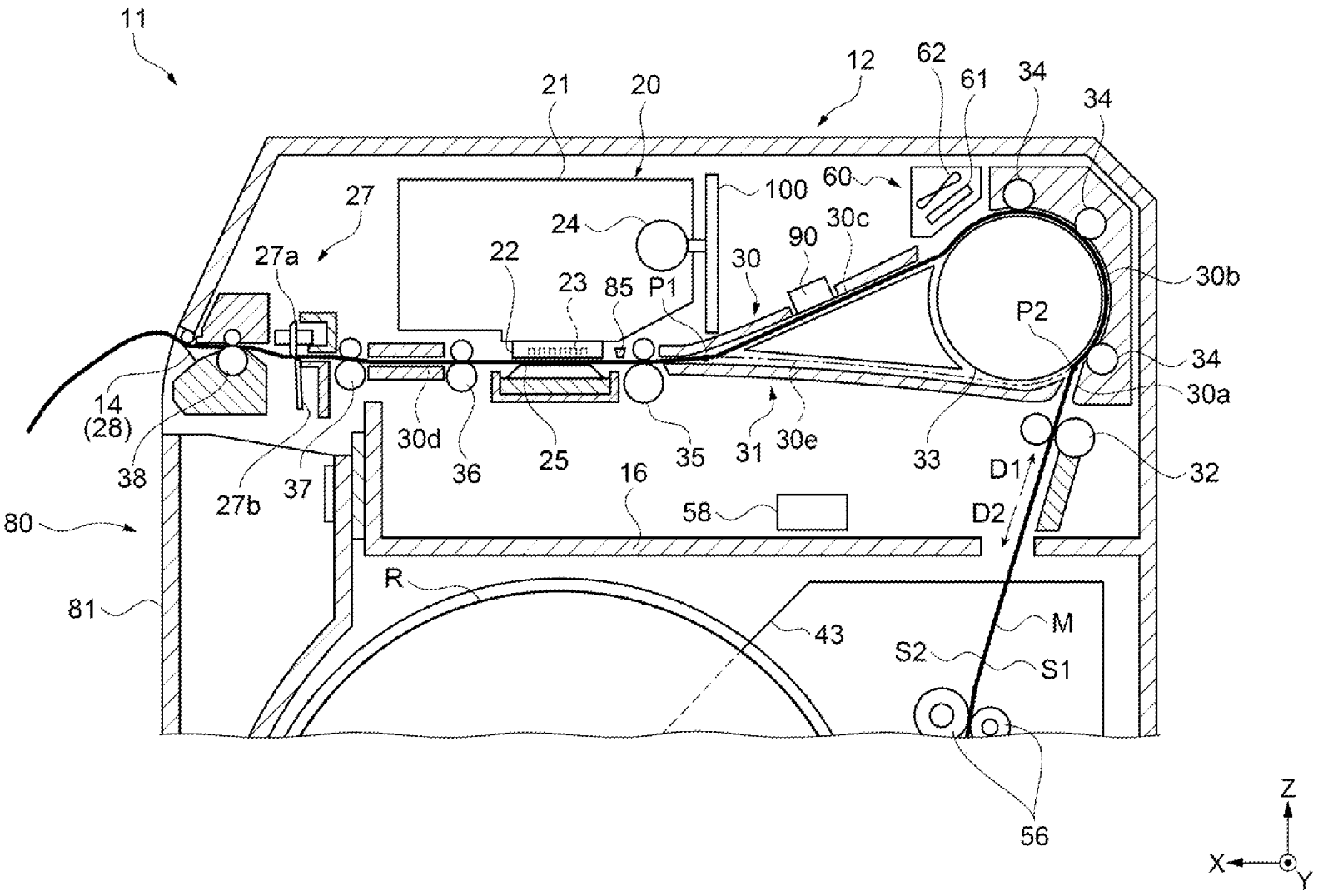
FIG. 6A is a schematic view illustrating another control method for the recording device according to the first embodiment.

As illustrated in FIG. 6A, the control unit 58 drives the transport unit 31 and the recording unit 20 and records an image on the first surface S1 of the medium M while transporting the medium M in the progressive feeding direction D1 of the transport path 30.

Figure 6B:
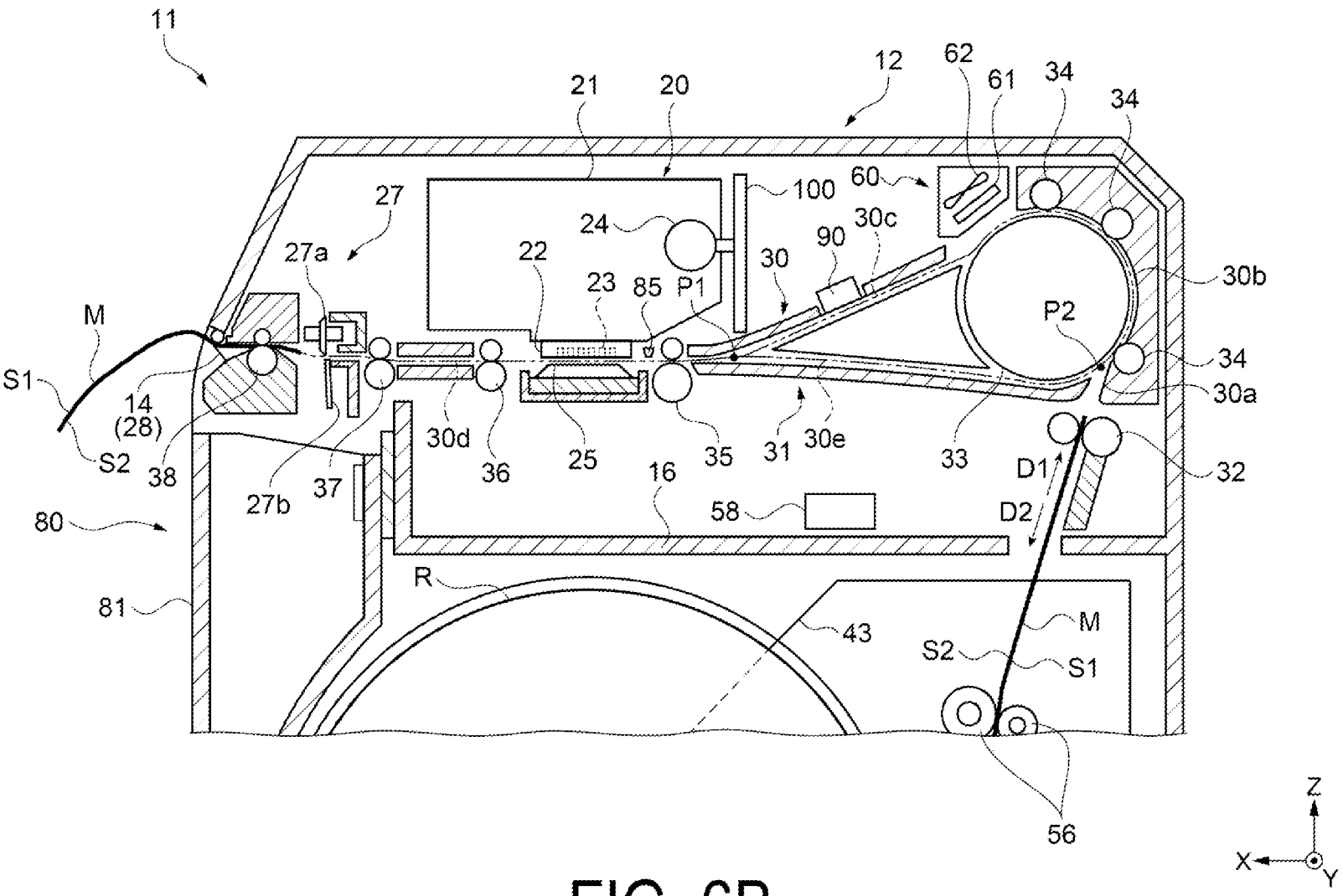
FIG. 6B is a schematic view illustrating the other control method for the recording device according to the first embodiment.

Next, as illustrated in FIG. 6B, at a predetermined juncture, the control unit 58 drives the cutting unit 27 and cuts the medium M. In addition, the control unit 58 stops driving the downstream third transport roller pair 38 and holds the medium M that has been cut into a cut sheet.

In addition, the control unit 58 drives the roll paper transport roller pair 56, the feed roller pair 32, the middle roller 33, the upstream transport roller pair 35, the downstream first transport roller pair 36 and the downstream second transport roller pair 37 to rotate in reverse and transports the medium M in the reverse feeding direction D2 of the transport path 30. Then, the driving is stopped at a position where the leading edge of the medium M is held in the feed roller pair 32.

Figure 6C:
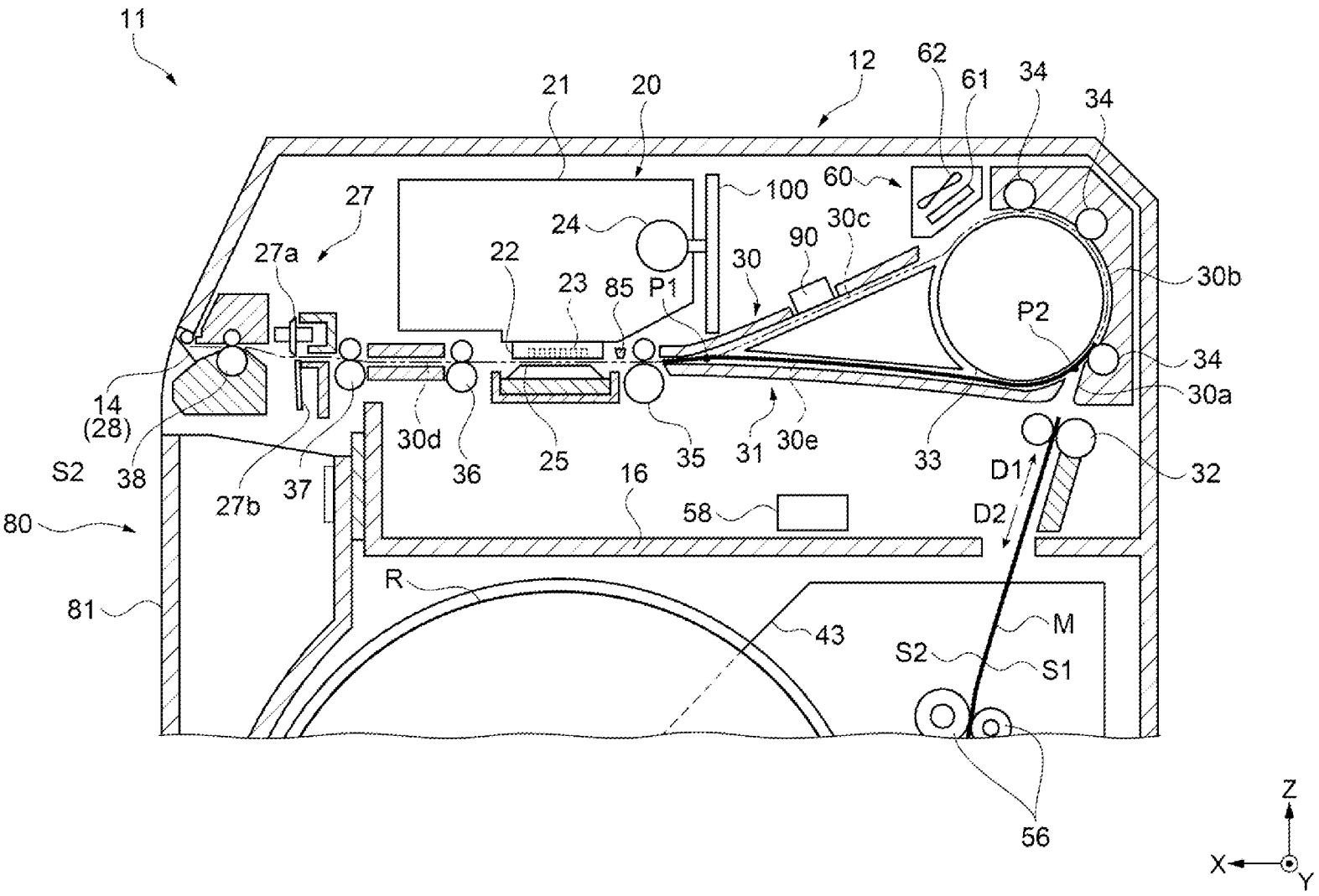
FIG. 6C is a schematic view illustrating the other control method for the recording device according to the first embodiment.

Next, as illustrated in FIG. 6C, the control unit 58 drives the downstream third transport roller pair 38 to rotate in reverse and also drives the upstream transport roller pair 35, the downstream first transport roller pair 36 and the downstream second transport roller pair 37 to rotate in reverse, transports the medium M in the reverse feeding direction D2 of the transport path 30 and draws the medium M into the inversion path 30*e*.

Figure 6D:
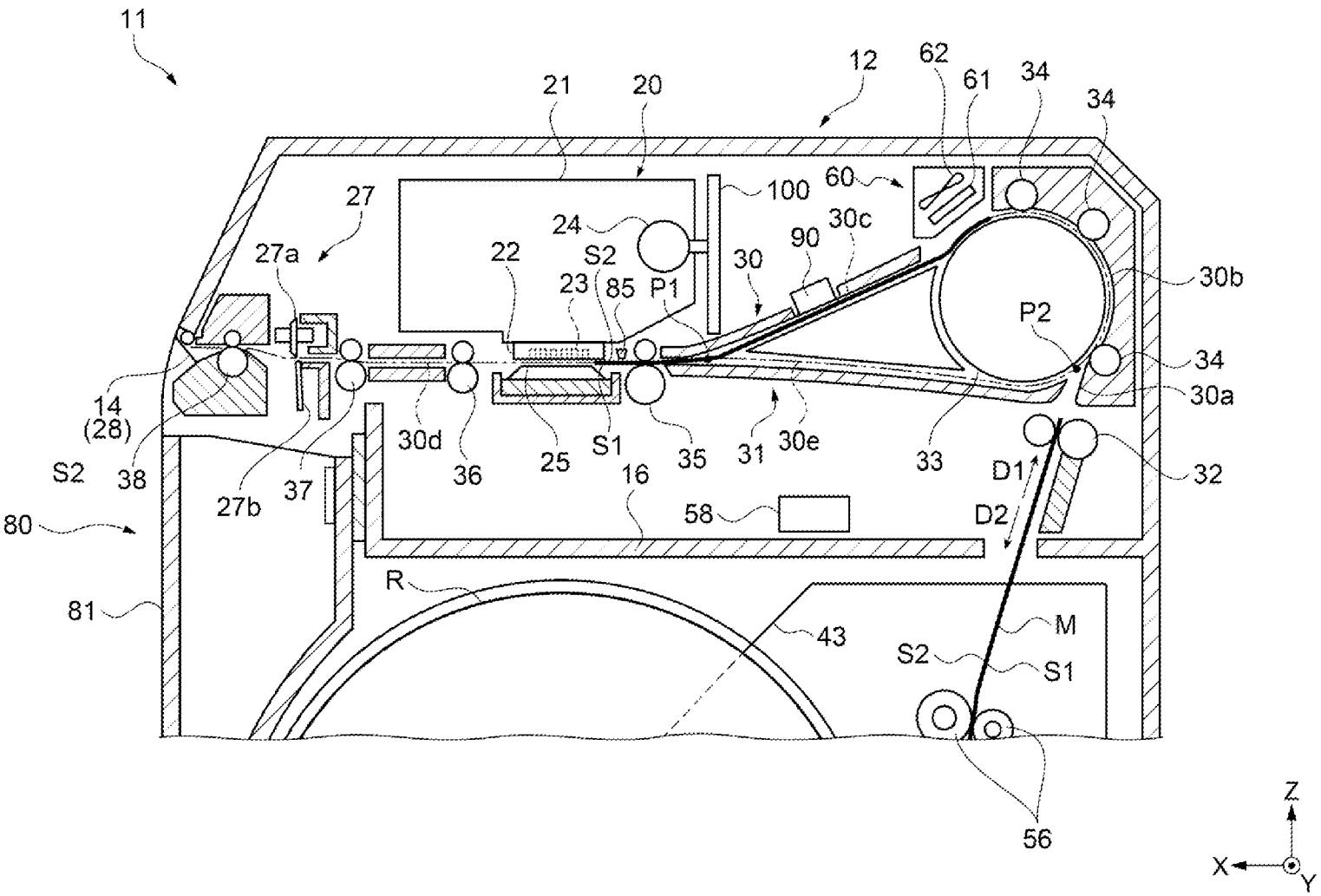
FIG. 6D is a schematic view illustrating the other control method for the recording device according to the first embodiment.

Next, as illustrated in FIG. 6D, the control unit 58 drives the middle roller 33 and the upstream transport roller pair 35 to rotate forward and transports the medium M via the curved path 30*b* and the second path 30*c* toward the head 22. Accordingly, the medium M is inverted and the second surface S2 of the medium M faces the head 22.

Next, while the medium M is transported in the progressive feeding direction D1, ink is dispensed onto the second surface S2 of the medium M and the image is recorded. Accordingly, recording is performed on the first surface S1 and the second surface S2 of the medium M. In other words, double-sided printing is performed.

Thereafter, when the medium M is further transported in the progressive feeding direction D1, the medium M is discharged from the discharge unit 28.

At this point, foreign material adhesion to the imaging unit 90 will be described. The foreign material is, for example, a mist. As described above, the recording device 11 is an inkjet recording device. Therefore, when ink is dispensed from the head 22, minute liquid particles (mist) are produced and are suspended in the air. This represents a challenge in that this mist adheres to the imaging unit 90. When the mist adheres to the imaging unit 90, a recording status of the medium M cannot be accurately captured.

Therefore, in the embodiment, a restricting wall 100 is provided for inhibiting the adhesion of mist to the imaging unit 90. Hereafter, a specific form of the restricting wall 100 will be described.

Figure 7:
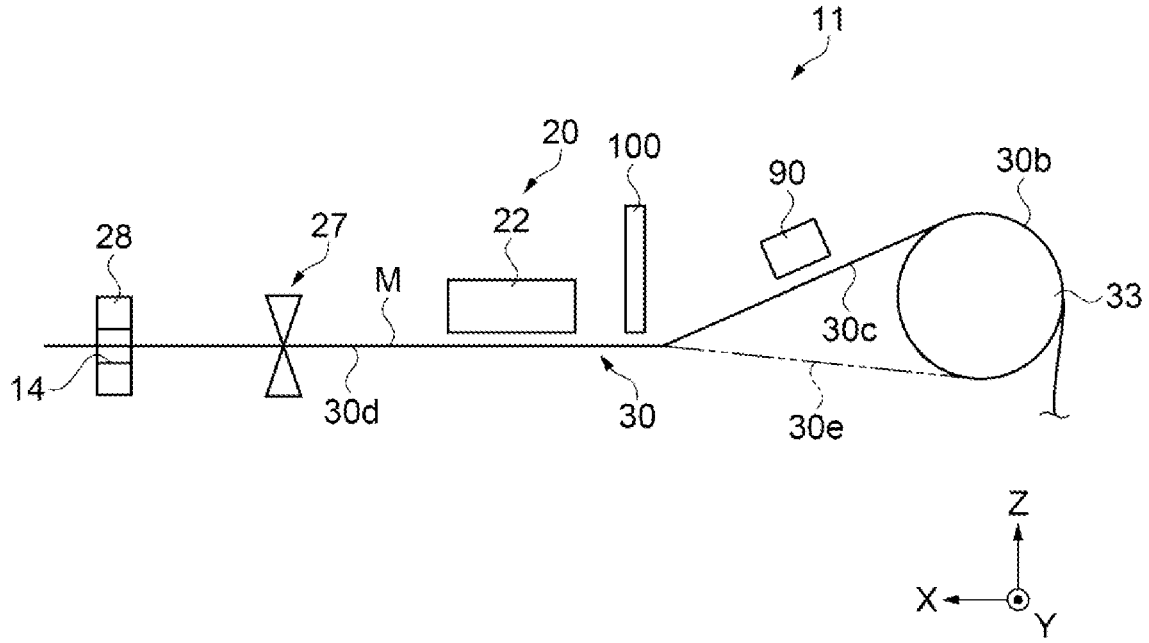
FIG. 7 is a partial enlarged schematic view illustrating the internal configuration of the recording device according to the first embodiment.

FIG. 7 is a partial enlarged schematic view illustrating an internal configuration of the recording device 11.

As illustrated in FIG. 7, a restricting wall 100 narrowing a space above the medium M on the transport path 30 is provided between the recording unit 20 and the imaging unit 90. The restricting wall 100 has a plate shape. The restricting wall 100 extends in a direction along the Z axis. Therefore, the space above the medium M where the restricting wall 100 is disposed is very narrow compared to when there is no restricting wall 100.

Note that in the embodiment, the guide frame 100 supporting the carriage 21 functions as the restricting wall 100 (see FIG. 3).

The restricting wall 100 restricts movement of the mist produced by the recording unit 20 toward the imaging unit 90. Accordingly, the adhesion of mist to the imaging unit 90 is inhibited. Thus, the recording status of the medium M can be accurately captured by the imaging unit 90. In addition, maintenance operations such as removing mist adhered to the imaging unit 90 are reduced and the number of steps can be decreased.

Furthermore, when the guide frame 100 is used as the restricting wall 100, there is no need to install a separate restricting wall and therefore the configuration can be simplified.

Figure 8:
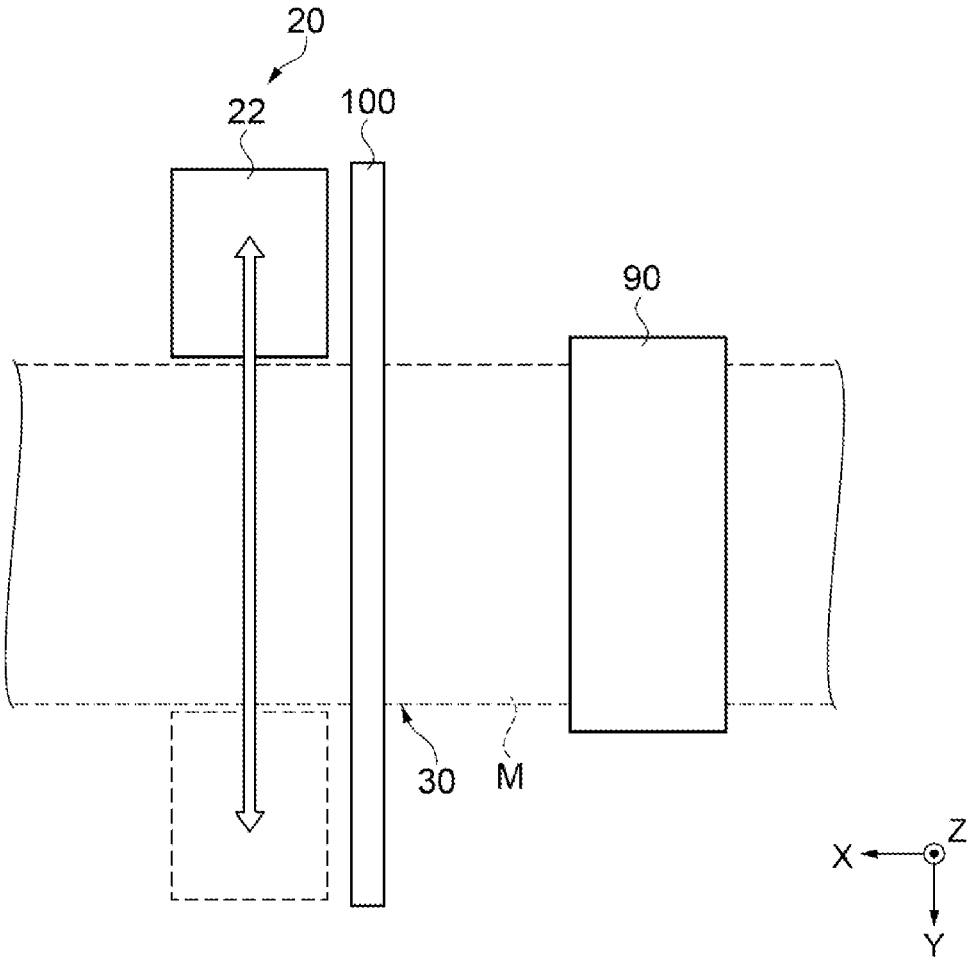
FIG. 8 is a partial enlarged schematic view illustrating the internal configuration of the recording device according to the first embodiment.

Additionally, as illustrated in FIG. 8, a width dimension (dimension in a direction along the Y axis) of the restricting wall 100 intersecting with the transport direction of the medium M is longer than a width dimension (dimension in the direction along the Y axis) of the transport path intersecting with the transport direction of the transport path transporting the medium M. In addition, the width dimension of the restricting wall 100 is longer than a width dimension (dimension in the direction along the Y axis) of the imaging unit 90 intersecting the transport direction of the transport path transporting the medium M. Note that the width dimension of the imaging unit 90 is substantially equal to the width dimension of the transport path transporting the medium M.

In addition, the width dimension of the restricting wall 100 is substantially equal to a movement region in which the carriage 21 (head 22) reciprocates in the direction along the Y axis. Accordingly, the adhesion of mist is inhibited across the entire width direction of the imaging unit 90.

Furthermore, when the medium M is transported in the progressive feeding direction D1, airflow is produced on the downstream side, and thus when the imaging unit 90 is disposed upstream of the recording unit 20, the mist is unlikely to adhere to the imaging unit 90.

2. Second Embodiment

Next, a second embodiment will be described. Specifically, an arrangement of the imaging unit 90 and the restricting wall 100 in a recording device 11A will be described. Note that configurations identical to the first embodiment will be denoted by the same reference signs and redundant descriptions will be omitted.

Figure 9:
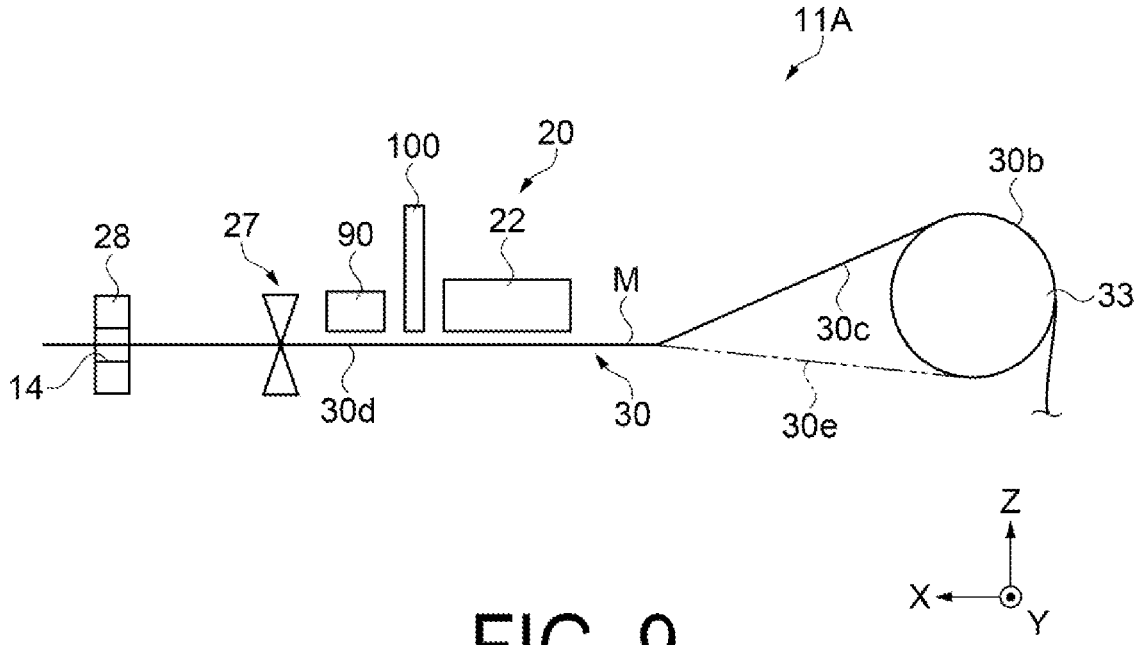
FIG. 9 is a partial enlarged schematic view illustrating an internal configuration of a recording device according to a second embodiment.

FIG. 9 is a partial enlarged schematic view illustrating an internal configuration of the recording device 11A according to the embodiment.

As illustrated in FIG. 9, the imaging unit 90 in the recording device 11A is disposed between the recording unit 20 and the discharge unit 28. In other words, in the embodiment, the imaging unit 90 is disposed downstream of the recording unit 20. Note that in the embodiment, the imaging unit 90 is disposed between the recording unit 20 and the cutting unit 27. Also, the restricting wall 100 is disposed between the recording unit 20 and the imaging unit 90. The restricting wall 100 has a similar function as in the first embodiment and narrows the space above the medium M on the transport path 30.

In the recording device 11A, the medium M is transported in the progressive feeding direction D1 of the transport path 30, and after the test pattern is recorded on the medium M, the medium M is transported in the progressive feeding direction D1 and the test pattern is captured by the imaging unit 90. Thereafter, the medium M is transported in the progressive feeding direction D1 and the portion of the medium M where the test pattern is recorded is cut by the cutting unit 27.

According to the embodiment, the restricting wall 100 can inhibit the adhesion of mist to the imaging unit 90. Further, unlike the first embodiment, since the imaging unit 90 is disposed downstream of the recording unit 20, there is no need to transport the medium M in the reverse feeding direction D2 and a process of transporting the medium M can be performed easily.

3. Third Embodiment

Next, a third embodiment will be described. Specifically, an arrangement of the imaging unit 90, the restricting wall 100 and another restricting wall 101 in a recording device 11B will be described. Note that configurations identical to those in the first embodiment will be denoted by the same reference signs and redundant descriptions will be omitted.

Figure 10:
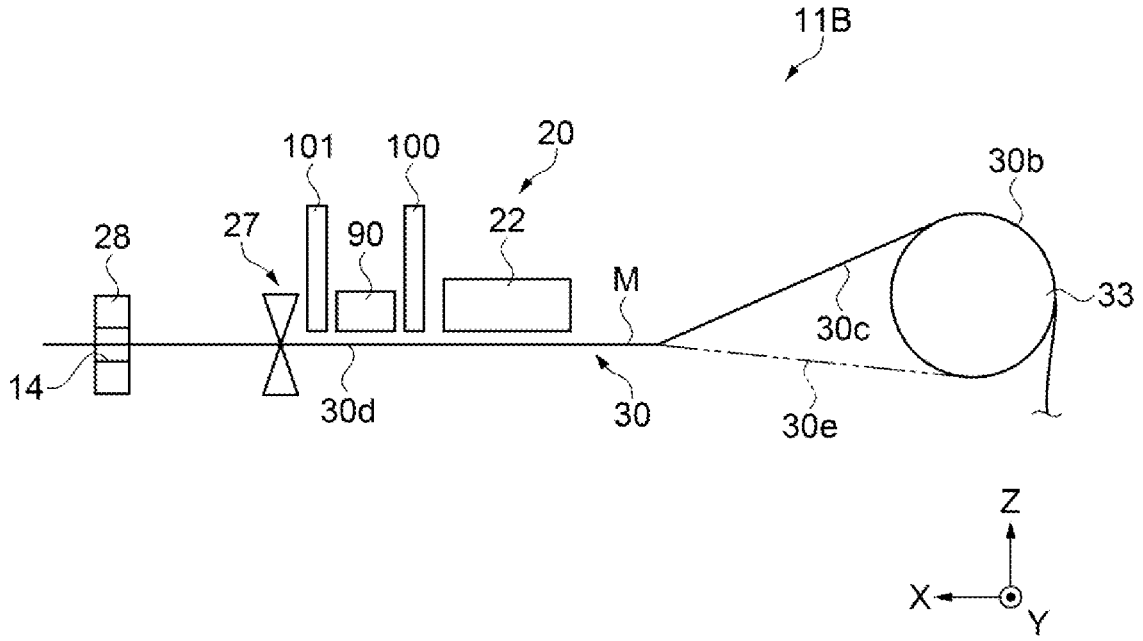
FIG. 10 is a partial enlarged schematic view illustrating an internal configuration of a recording device according to a third embodiment.

FIG. 10 is a partial enlarged schematic view illustrating an internal configuration of the recording device 11B according to the embodiment.

As illustrated in FIG. 10, the imaging unit 90 in the recording device 11B is disposed between the recording unit 20 and the cutting unit 27. Also, the restricting wall 100 is disposed between the recording unit 20 and the imaging unit 90. Further, the other restricting wall 101 is disposed between the imaging unit 90 and the cutting unit 27. The other restricting wall 101 has a similar function to the restricting wall 100 and narrows the space above the medium M on the transport path 30.

According to the embodiment, the restricting wall 100 can inhibit the adhesion of mist to the imaging unit 90. Furthermore, the other restricting wall 101 can inhibit adhesion of paper dust produced by the cutting unit 27 to the imaging unit 90.

4. Fourth Embodiment

Next, a fourth embodiment will be described. In the embodiments described above, the mist produced by the recording unit 20 was described as an example of foreign material adhering to the imaging unit 90, but paper dust produced by the cutting unit 27 is considered as another type of foreign material. When the paper dust adheres to the imaging unit 90, the recording status of the medium M cannot be accurately captured.

Therefore, in the embodiment, a configuration will be described for inhibiting the adhesion of paper dust to the imaging unit 90. Note that configurations identical to the first embodiment will be denoted by the same reference signs and redundant descriptions will be omitted.

Figure 11:
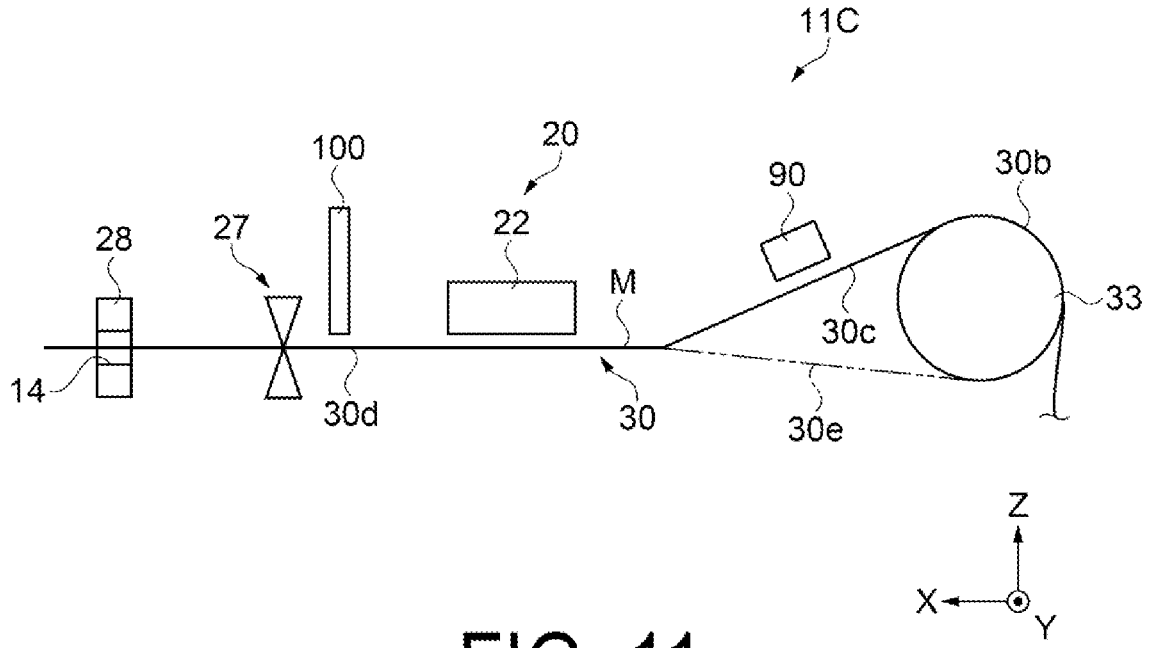
FIG. 11 is a partial enlarged schematic view illustrating an internal configuration of a recording device according to a fourth embodiment.

FIG. 11 is a partial enlarged schematic view illustrating an internal configuration of a recording device 11C according to the embodiment.

As illustrated in FIG. 11, the recording device 11C includes the storage unit 40 (see FIG. 3) where the medium M is stored, the recording unit 20 dispensing a liquid droplet onto the medium M transported from the storage unit 40 to perform recording, the cutting unit 27 cutting the medium M on which recording was performed, the discharge unit 28 discharging the cut medium M and the imaging unit 90 disposed on the transport path 30 that runs from the storage unit 40, past the recording unit 20, to the cutting unit 27 and the discharge unit 28, the imaging unit 90 capturing an image of the medium M on which recording was performed. Also, the restricting wall 100 narrowing the space above the medium M on the transport path 30 is included between the imaging unit 90 and the cutting unit 27.

In the embodiment, the transport path 30 includes, between the storage unit 40 and the recording unit 20, the curved path 30*b* inverting and transporting the medium M to the recording unit 20, and the imaging unit 90 is disposed between the recording unit 20 and the curved path 30*b* on the transport path 30.

Accordingly, the restricting wall 100 restricts the paper dust produced by the cutting unit 27 from moving toward the imaging unit 90 and adhesion of the paper dust to the imaging unit 90 is inhibited. Therefore, the recording status of the medium M in the imaging unit 90 can be accurately captured. In addition, maintenance operations such as removal of the paper dust adhered to the imaging unit 90 are reduced and the number of steps can be decreased.

Note that the restricting wall 100 may be disposed between the imaging unit 90 and the recording unit 20. When configured in this way, adhesion of the paper dust to the imaging unit 90 as well as adhesion of the mist produced by the recording unit 20 can be inhibited.

5. Fifth Embodiment

Next, a fifth embodiment will be described. Specifically, an arrangement of the imaging unit 90 and the restricting wall 100 in a recording device 11D will be described. Note that configurations identical to the first embodiment will be denoted by the same reference signs and redundant descriptions will be omitted.

Figure 12:
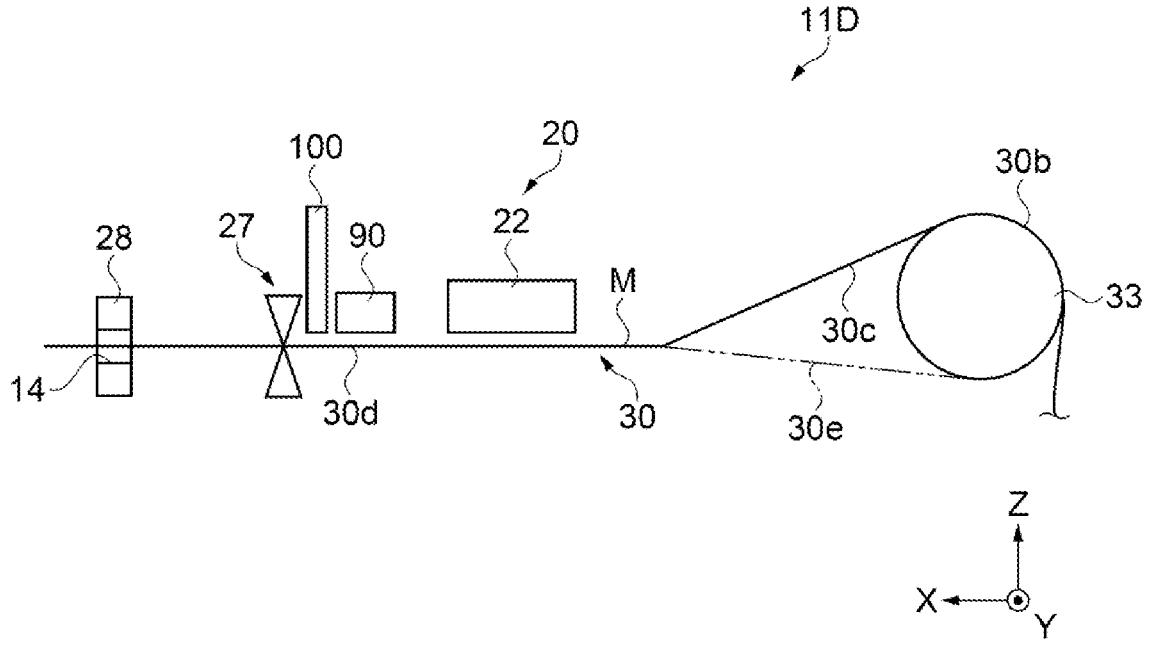
FIG. 12 is a partial enlarged schematic view illustrating an internal configuration of a recording device according to a fifth embodiment.

FIG. 12 is a partial enlarged schematic view illustrating an internal configuration of the recording device 11D according to the embodiment.

As illustrated in FIG. 12, the imaging unit 90 in the recording device 11D is disposed between the recording unit 20 and the cutting unit 27. Also, the restricting wall 100 is disposed between the recording unit 20 and the cutting unit 27.

According to the embodiment, the restricting wall 100 can inhibit the adhesion of paper dust to the imaging unit 90. Further, unlike the fourth embodiment, since the imaging unit 90 is disposed downstream of the recording unit 20, there is no need to transport the medium M in the reverse feeding direction D2 and the process of transporting the medium M can be performed easily.

6. Sixth Embodiment

Next, a sixth embodiment will be described. Specifically, an arrangement of the imaging unit 90, the restricting wall 100 and the other restricting wall 101 in a recording device 11E will be described. Note that configurations identical to the first embodiment will be denoted by the same reference signs and redundant descriptions will be omitted.

Figure 13:
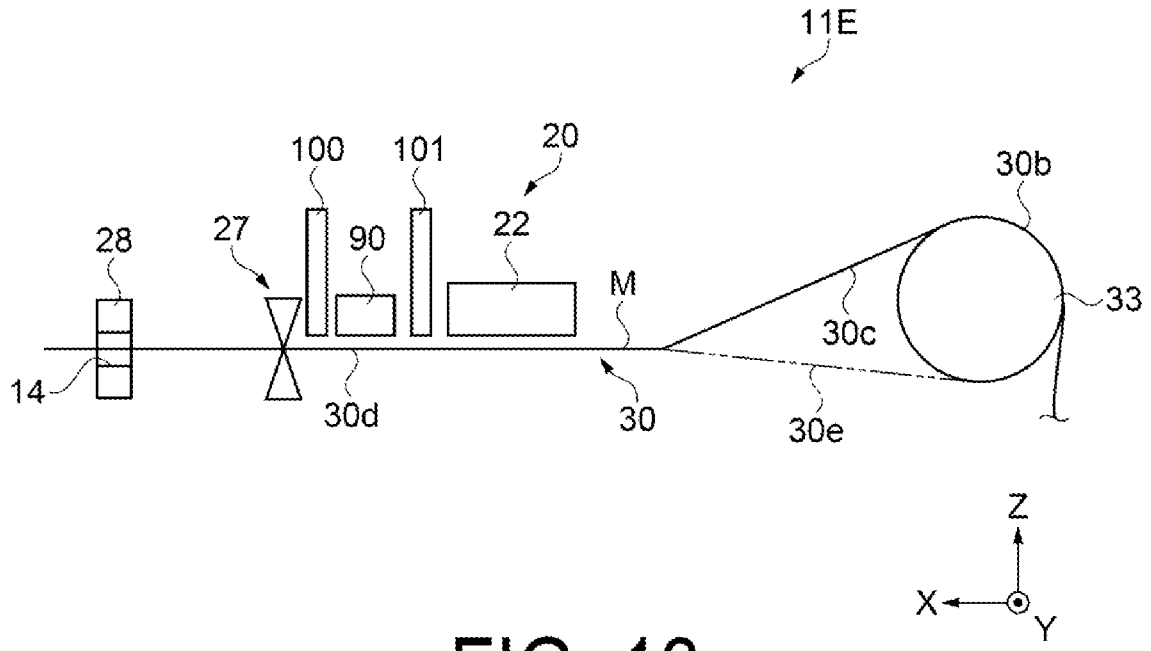
FIG. 13 is a partial enlarged schematic view illustrating an internal configuration of a recording device according to a sixth embodiment.

FIG. 13 is a partial enlarged schematic view illustrating an internal configuration of the recording device 11E according to the embodiment.

As illustrated in FIG. 13, the imaging unit 90 in the recording device 11E is disposed between the recording unit 20 and the cutting unit 27. Also, the restricting wall 100 is disposed between the imaging unit 90 and the cutting unit 27. Further, the other restricting wall 101 is disposed between the recording unit 20 and the imaging unit 90. The other restricting wall 101 has a similar function to the restricting wall 100 and narrows the space above the medium M on the transport path 30.

According to the embodiment, the restricting wall 100 can inhibit the adhesion of paper dust to the imaging unit 90. Furthermore, the other restricting wall 101 can inhibit the adhesion of mist produced from the recording unit 20 to the imaging unit 90.

7. Seventh Embodiment

Next, a seventh embodiment will be described. Specifically, an arrangement of the imaging unit 90 and the restricting wall 100 in a recording device 11F will be described. Note that configurations identical to the first embodiment will be denoted by the same reference signs and redundant descriptions will be omitted.

Figure 14:
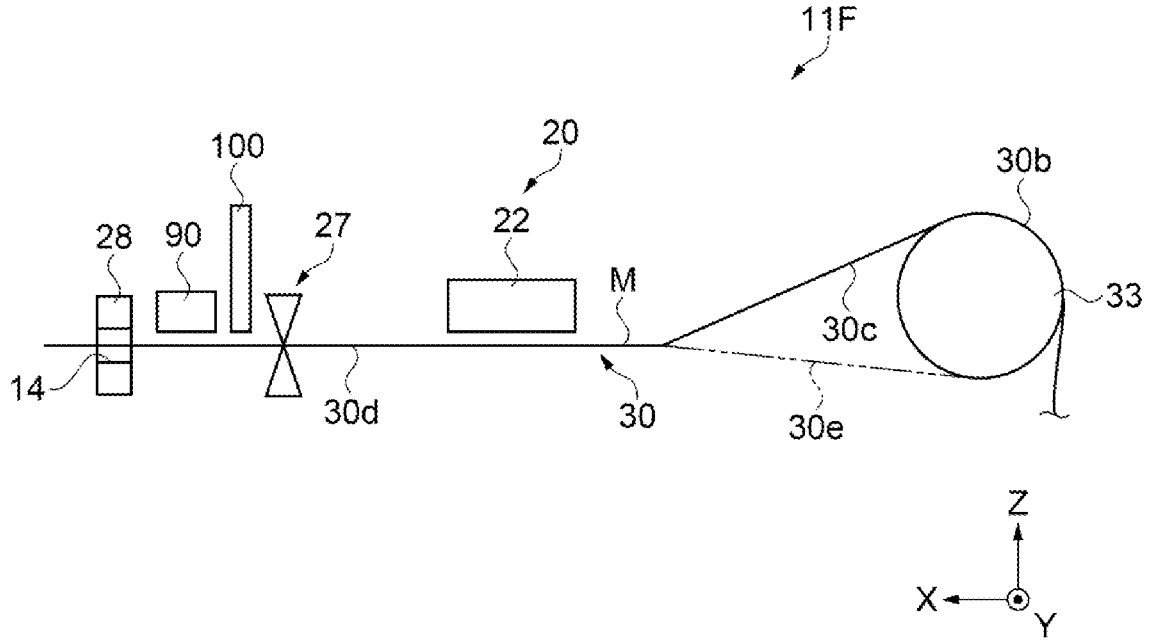
FIG. 14 is a partial enlarged schematic view illustrating an internal configuration of a recording device according to a seventh embodiment.

FIG. 14 is a partial enlarged schematic view illustrating an internal configuration of the recording device 11F according to the embodiment.

As illustrated in FIG. 14, the imaging unit 90 in the recording device 11F is disposed between the cutting unit 27 and the discharge unit 28. Also, the restricting wall 100 is disposed between the cutting unit 27 and the imaging unit 90.

According to the embodiment, the restricting wall 100 can inhibit the adhesion of paper dust to the imaging unit 90. Further, unlike the fourth embodiment, since the imaging unit 90 is disposed downstream of the recording unit 20, there is no need to transport the medium M in the reverse feeding direction D2 and the process of transporting the medium M can be performed easily. Furthermore, the medium M can be cut immediately after image capture by the imaging unit 90, increasing transport efficiency.

8. Eighth Embodiment

Next, an eighth embodiment will be described. Specifically, an arrangement of the imaging unit 90, the restricting wall 100 and the other restricting wall 101 in a recording device 11G will be described. Note that configurations identical to the first embodiment will be denoted by the same reference signs and redundant descriptions will be omitted.

Figure 15:
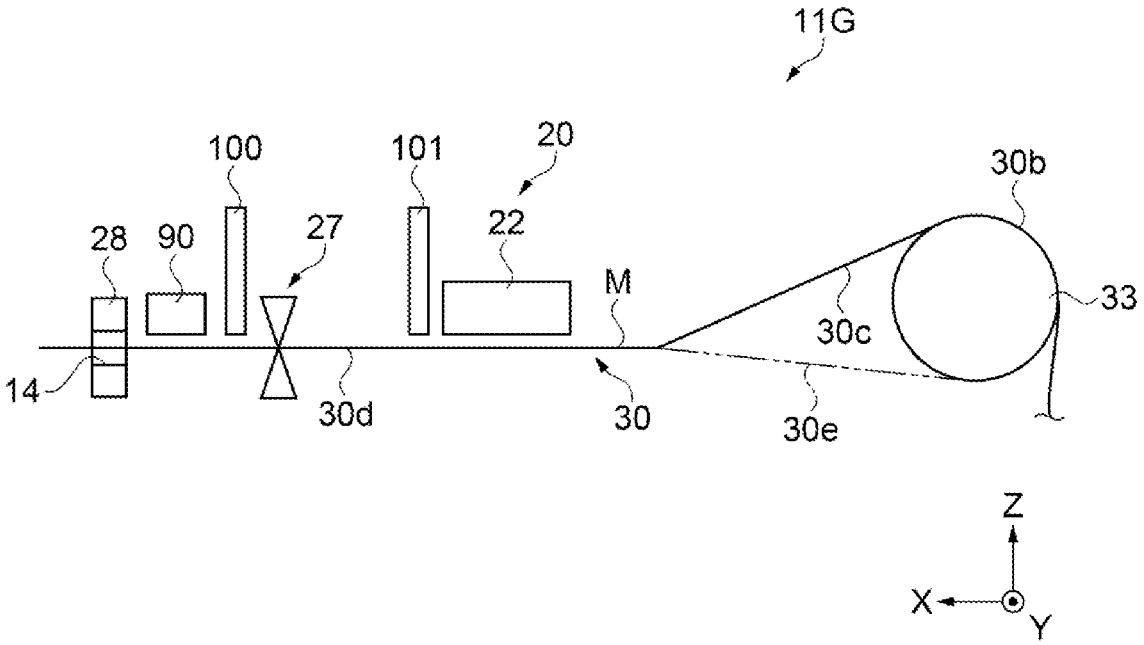
FIG. 15 is a partial enlarged schematic view illustrating an internal configuration of a recording device according to an eighth embodiment.

FIG. 15 is a partial enlarged schematic view illustrating an internal configuration of the recording device 11G according to the embodiment.

As illustrated in FIG. 15, the imaging unit 90 in the recording device 11G is disposed between the cutting unit 27 and the discharge unit 28. Also, the restricting wall 100 is disposed between the cutting unit 27 and the imaging unit 90. Further, the other restricting wall 101 is disposed between the recording unit 20 and the cutting unit 27. The other restricting wall 101 has a similar function to the restricting wall 100 and narrows the space above the medium M on the transport path 30. Even with this configuration, similar advantages as described above can be obtained.

9. Ninth Embodiment

In the embodiments described above, a long medium wound into a roll was described as an example of the medium M, but the present disclosure is not limited to this and may be a cut-sheet medium M1.

Figure 16:
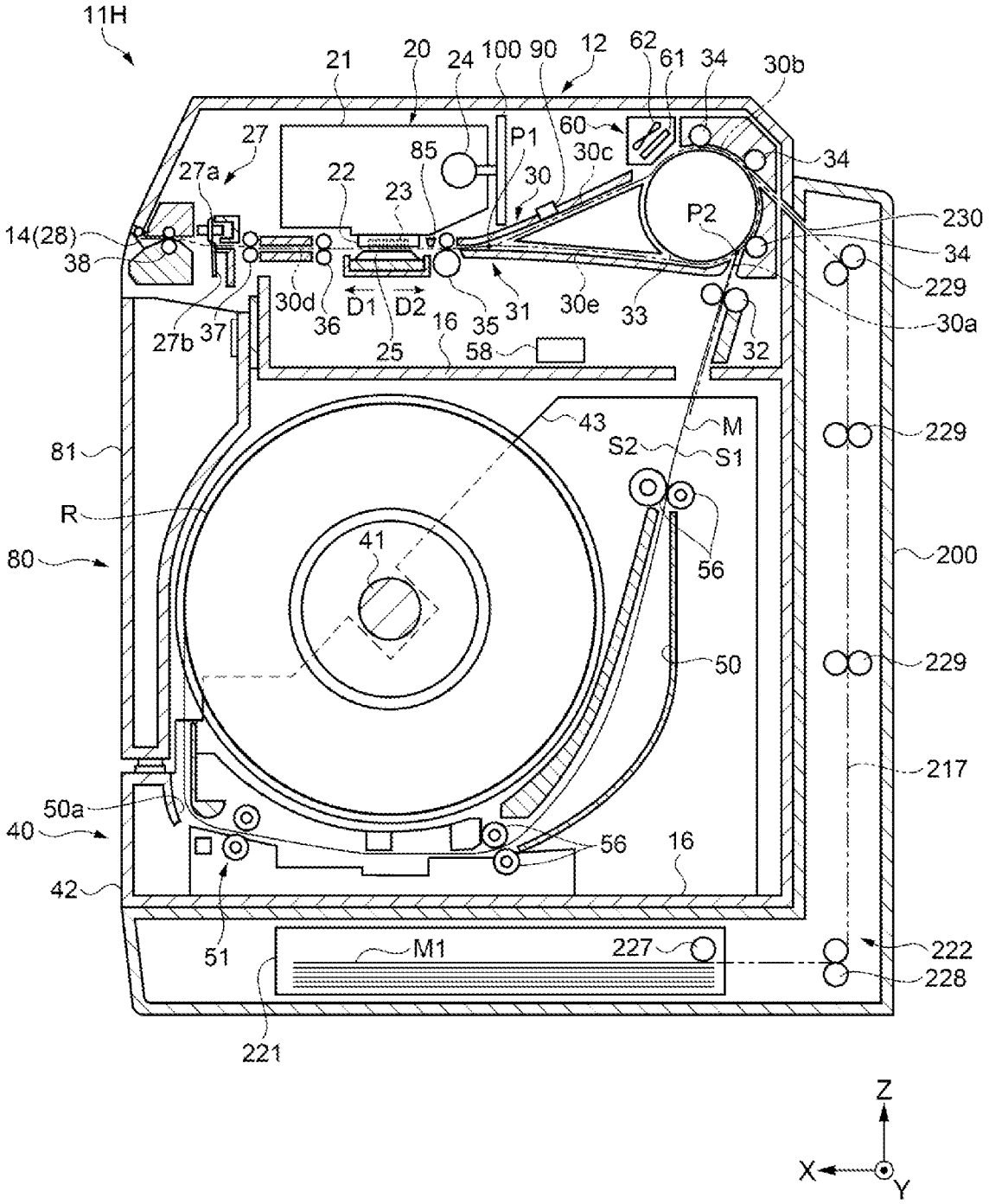
FIG. 16 is a cross-sectional schematic view illustrating an internal configuration of a recording device according to a ninth embodiment.

FIG. 16 is a cross-sectional schematic view illustrating an internal configuration of a recording device 11H according to the embodiment.

The recording device 11H is configured to be capable of recording on the long medium M wound into a roll as well as on the cut-sheet medium M1. In addition, the recording device 11H is configured to be capable of double-sided printing on the cut-sheet medium M1.

As illustrated in FIG. 16, the recording device 11H is paired with an accommodating carrier 200 capable of transporting the medium M1, the accommodating carrier 200 accommodating a cassette 221 that accommodates the medium M1 on an outer surface of the housing 12 described above.

The accommodating carrier 200 has a feeding unit 222 transporting the medium M1 accommodated in the cassette 221 toward the curved path 30*b*.

The feeding unit 222 includes a pickup roller 227 feeding out the topmost medium M1 of the mediums M1 accommodated in a stacked state in the cassette 221, a separating roller pair 228 separating the medium M1 fed out by the pickup roller 227 into one sheet at a time and a transport roller pair 229 transporting the medium M1 along a cut-sheet transport path 217 toward the curved path 30*b*.

On a downstream end of the cut-sheet transport path 217, a communicating passage 230 is provided communicating with the curved path 30*b*.

The medium M1 transported from the cassette 221 is transported along the cut-sheet transport path 217 and merges into the curved path 30*b* via the communicating passage 230. The medium M1 that has merged into the curved path 30*b* is transported toward the recording unit 20 by the transport unit 31.

In addition, the medium M1 on which the recording unit 20 recorded can be transported in the reverse feeding direction D2, front and back sides of the medium M1 can be inverted via the inversion path 30*e*, the medium M1 can be transported in the progressive feeding direction D1 and transported to the recording unit 20 and recording can be performed on the opposite surface. Accordingly, double-sided printing is possible.

Note that the arrangement of the imaging unit 90 and the restricting wall 100 in the recording device 11H is similar to that in the above-described embodiments. With this configuration, similar advantages as described above can also be obtained with a configuration transporting the cut-sheet medium M1.

What is claimed is:

1. A recording device comprising:

a storage unit configured to store a medium;

a recording unit configured to dispense a liquid droplet onto the medium transported from the storage unit to perform recording;

a cutting unit configured to cut the medium on which recording was performed;

a discharge unit configured to discharge the medium on which recording was performed; and an imaging unit disposed on a transport path running from the storage unit, past the recording unit, to the discharge unit, the imaging unit being configured to capture an image of the medium on which recording was performed; wherein a restricting wall narrowing a space above the medium on the transport path is provided between the recording unit and the imaging unit, the restricting wall being separate from a housing of the recording device and having a width dimension in a direction intersecting with a transport direction of the medium that is longer than a width dimension in a direction intersecting with the transport direction of the medium of the transport path and is longer than a width dimension in a direction intersecting with the transport direction of the medium of the imaging unit.

2. The recording device according to claim 1, wherein the imaging unit is disposed between the storage unit and the discharge unit.

3. The recording device according to claim 1, wherein another restricting wall narrowing the space above the medium on the transport path is disposed between the cutting unit and the restricting wall.

4. A recording device comprising:

a storage unit configured to store a medium;

a recording unit configured to dispense a liquid droplet onto the medium transported from the storage unit to perform recording;

a cutting unit configured to cut the medium on which recording was performed;

a discharge unit configured to discharge the cut medium; and an imaging unit disposed on a transport path running from the storage unit, past the recording unit, to the cutting unit and the discharge unit, the imaging unit being configured to capture an image of the medium on which recording was performed; wherein a restricting wall narrowing a space above the medium on the transport path is provided between the imaging unit and the cutting unit, the transport path has a curved path provided between the storage unit and the recording unit, the curved path being configured to invert and transport the medium to the recording unit, the cutting unit cuts the medium on which recording was performed on a first surface thereof, the transport path includes an inversion path configured to invert and transport the medium cut by the cutting unit and to merge upstream of the curved path, and the recording unit dispenses the liquid droplet onto a second surface opposite from the first surface of the medium inverted and transported by the inversion path.

5. The recording device according to claim 4, wherein the transport path between the curved path and the recording unit is inclined downward from an upper end of the curved path toward a dispensing surface of the recording unit where the liquid droplet is dispensed, and at least a portion of the imaging unit is disposed between the upper end of the curved path and the dispensing surface of the recording unit in a height direction.

6. The recording device according to claim 4, wherein a transport roller is disposed transporting the medium along an outer circumferential surface of the curved path.

7. The recording device according to claim 4, wherein the imaging unit is disposed between the recording unit and the cutting unit.

8. The recording device according to claim 7, wherein the restricting wall is disposed between the imaging unit and the cutting unit, and another restricting wall narrowing a space above the medium on the transport path is disposed between the recording unit and the imaging unit.

9. The recording device according to claim 4, wherein the imaging unit is disposed between the cutting unit and the discharge unit.

10. The recording device according to claim 9, wherein the restricting wall is disposed between the imaging unit and the cutting unit, and another restricting wall narrowing the space above the medium on the transport path is disposed between the recording unit and the cutting unit.

11. A recording device comprising:

a storage unit configured to store a medium;

a recording unit configured to dispense a liquid droplet onto the medium transported from the storage unit to perform recording;

a discharge unit configured to discharge the medium on which recording was performed; and an imaging unit disposed on a transport path running from the storage unit, past the recording unit, to the discharge unit, the imaging unit being configured to capture an image of the medium on which recording was performed; wherein a restricting wall narrowing a space above the medium on the transport path is provided between the recording unit and the imaging unit, the transport path has a curved path provided between the storage unit and the recording unit, the curved path being configured to invert and transport the medium to the recording unit, the transport path includes an inversion path configured to invert and transport a cut-sheet medium and to merge upstream of the curved path, and the imaging unit is disposed between the curved path and the recording unit.

12. The recording device according to claim 11, wherein a cutting unit configured to cut the medium on which recording was performed on a first surface thereof is provided between the recording unit and the discharge unit, and the recording unit dispenses the liquid droplet onto a second surface opposite from the first surface of the medium inverted and transported by the inversion path.

13. The recording device according to claim 11, wherein the transport path between the curved path and the recording unit is inclined downward from an upper end of the curved path toward a dispensing surface of the recording unit where the liquid droplet is dispensed, and at least a portion of the imaging unit is disposed between the upper end of the curved path and the dispensing surface of the recording unit in a height direction.

14. The recording device according to claim 11, wherein a transport roller is disposed transporting the medium along an outer circumferential surface of the curved path.

15. The recording device according to claim 11, wherein a width dimension, intersecting a transport direction of the medium, of the restricting wall is longer than a width dimension, intersecting the transport direction of the medium, of the imaging unit.

* * * * *